US012222108B2

(12) United States Patent
Bhosale et al.

(10) Patent No.: US 12,222,108 B2
(45) Date of Patent: Feb. 11, 2025

(54) DOOR FOR AN OVEN WITH DECREASED DISTANCE BETWEEN DOOR AND A LOWER VENT PANEL OR LOWER SECOND DOOR

(71) Applicant: WHIRLPOOL CORPORATION, Benton Harbor, MI (US)

(72) Inventors: Dhanaji Haridas Bhosale, Solapur (IN); Rohan Gajananrao Gore, Stevensville, MI (US); Giovanni Prandini, Saltrio (IT)

(73) Assignee: Whirlpool Corporation, Benton Harbor, MI (US)

( * ) Notice: Subject to any disclaimer, the term of this patent is extended or adjusted under 35 U.S.C. 154(b) by 903 days.

(21) Appl. No.: 17/220,600

(22) Filed: Apr. 1, 2021

(65) Prior Publication Data

US 2022/0316712 A1 Oct. 6, 2022

(51) Int. Cl.

| | |
|---|---|
| ***F24C 15/02*** | (2006.01) |
| ***F24C 15/04*** | (2006.01) |
| *F24C 15/08* | (2006.01) |
| *F24C 15/22* | (2006.01) |

(52) U.S. Cl.

CPC ..... *F24C 15/023* (2013.01); *F24C 15/04* (2013.01); *F24C 15/021* (2013.01); *F24C 15/045* (2013.01); *F24C 15/08* (2013.01); *F24C 15/22* (2013.01)

(58) Field of Classification Search

CPC ..... F24C 15/023; F24C 15/04; F24C 15/08; F24C 15/045; F24C 15/021; F24C 15/22

USPC ..... 126/194

See application file for complete search history.

(56) References Cited

U.S. PATENT DOCUMENTS

| | | | | |
|---|---|---|---|---|
| 1,511,700 | A | 10/1924 | Wilkinson et al. | |
| 2,555,841 | A | 6/1951 | Clark | |
| 2,739,584 | A | 3/1956 | Hupp | |
| 5,957,557 | A * | 9/1999 | Langer | F24C 15/08 312/236 |
| 2019/0003721 | A1 | 1/2019 | Jang et al. | |
| 2019/0145628 | A1 * | 5/2019 | Ladner | F16B 11/006 126/200 |
| 2019/0353353 | A1 * | 11/2019 | White | F24C 15/023 |

FOREIGN PATENT DOCUMENTS

| | | | |
|---|---|---|---|
| BE | 407506 | A | 2/1935 |
| CN | 201479802 | U | 5/2010 |
| CN | 107975312 | A | 5/2018 |
| DE | 2810123 | C2 | 8/1985 |
| DE | 3345999 | C2 | 10/1985 |

(Continued)

*Primary Examiner* — Steven B McAllister
*Assistant Examiner* — Benjamin W Johnson
(74) *Attorney, Agent, or Firm* — Price Heneveld LLP

(57) ABSTRACT

A door for an oven comprising: a hinge assembly providing an axis of rotation for the door; a glass panel, the glass panel comprising (i) a first primary surface providing an exterior surface of the door that is open to an external environment and (ii) a length parallel to the axis of rotation, and a filler panel disposed (i) at least partially below the glass panel and (ii) at least partially between the axis of rotation and a plane that the first primary surface of the glass panel forms, the filler panel comprising a length parallel to the axis of rotation, and the length of the filler panel differs from the length of the glass panel by less than 5%.

19 Claims, 20 Drawing Sheets

(56) References Cited

FOREIGN PATENT DOCUMENTS

| | | | | | |
|---|---|---|---|---|---|
| EP | 1936282 | A2 * | 6/2008 | ..... | E05D 3/02 |
| EP | 3284888 | A1 | 2/2018 | | |
| GB | 864816 | A * | 8/1959 | | |
| KR | 200299466 | Y1 | 1/2003 | | |
| KR | 100364567 | B1 | 8/2003 | | |
| KR | 20080035396 | A | 4/2008 | | |
| KR | 1020190001887 | A | 1/2019 | | |

* cited by examiner

DOOR FOR AN OVEN WITH DECREASED DISTANCE BETWEEN DOOR AND A LOWER VENT PANEL OR LOWER SECOND DOOR

BACKGROUND OF THE DISCLOSURE

The present disclosure generally relates to an oven door, and more specifically, to an oven door that allows for a decreased distance between the door and a lower vent panel or lower second door while maintaining a relatively large sized glass panel via a filler panel below the glass panel that accommodates placement of hinge assemblies close to the bottom and exterior surfaces of the door.

There is a problem in that, with some ovens, a distance between a bottom of a door and a top of another door, or the bottom of the door and a bottom vent, may be sufficiently large to allow access during use from an external environment surrounding the oven to a surface having an elevated temperature. The distance is sometimes a consequence of a position of an axis of rotation of the door relative to a cabinet. The further the axis of rotation is from a surface of the door facing the external environment, the greater the distance between the bottom of the door and the top of the other door (or the bottom vent) must be to allow the door to move from a closed position to an open position.

Certain design considerations limit the solution. For example, the distance must be sufficient to allow the door to move to, from, and between the closed position and the open position. In addition, it may be desirable to utilize a glass panel to provide a primary surface of the door facing the external panel, and to maximize a surface area that the glass panel provides, while minimizing the cost of manufacture of the glass panel.

SUMMARY OF THE DISCLOSURE

The present disclosure addresses the above problem and design considerations with a filler panel for the door. The filler panel is shaped to allow the placement of a portion of the hinge assemblies that provide the axis of rotation of the door within the door, but very close to the external surface of the door and to the bottom of the door. The glass panel is disposed above the filler panel, with the height of the filler panel being just sufficient to accommodate the hinge assemblies. Thus, the surface area of the glass panel is relatively maintained, but the axis of rotation of the door is positioned so that the distance that the door needs between the bottom of the door and the vent panel or second lower door to fully open and close is reduced (preventing access under the door from the external environment to the surface having the elevated temperature). The filler panel spans the length of the door that the glass panel would have occupied, thus imparting the structural integrity and temperature break functions that the glass panel would have provided to the door.

According to one aspect of the present disclosure, an oven comprises: (1) a base comprising inner walls defining a cooking chamber and an opening into the cooking chamber; and (2) a door pivotably coupled to the base via a hinge assembly attached to both the base and the door; (a) the hinge assembly providing an axis of rotation about which the door is movable relative to the base to, from, and between (i) an open position allowing access to the cooking chamber from an external environment through the opening and (ii) a closed position restricting access through the opening to the cooking chamber from the external environment, (b) the door comprising a glass panel, the glass panel comprising a first primary surface and a second primary surface, the first primary surface being at least partially exposed to the external environment when the door is in the closed position, and (c) the hinge assembly comprising a projection extending toward the external environment from the axis of rotation, when the door is in the closed position; wherein, the second primary surface of the glass panel forms a plane that intersects with the projection of the hinge assembly. In embodiments, the glass panel has a bottom edge that faces the hinge assembly. In embodiments, the bottom edge of the glass panel is entirely more elevated than the axis of rotation when the door is in the closed position.

In embodiments, the door further comprises a filler panel that is at least partially disposed below the glass panel when the door is in the closed position. In embodiments, the filler panel is at least partially disposed between the axis of rotation and a plane that the first surface of the glass panel forms. In embodiments, the filler panel comprises (i) a first primary surface that faces away from the axis of rotation and in a same direction as the first primary surface of the glass panel and (ii) a second primary surface that faces the axis of rotation and in a same direction as the second primary surface of the glass panel. In embodiments, both the first primary surface and the second primary surface of the filler panel are at least partially disposed between (i) a plane that the first primary surface of the glass panel forms and (ii) the axis of rotation. In embodiments, the second primary surface of the filler panel forms a plane that intersects with the projection of the hinge assembly. In embodiments, the filler panel includes a recessed portion contiguous with the second primary surface that accommodates the projection of the hinge assembly.

In embodiments, the filler panel comprises (i) a tab that extends upwards, when the door is in the closed position, and that faces the second primary surface of the glass panel and (ii) another tab that extend upwards, when the door is in the closed position, and faces the first primary surface of the glass panel. In embodiments, the door further comprises a double-sided adhesive strip adhered to both the tab of the filler panel and the second primary surface of the glass panel. In embodiments, the filler panel comprises a tab that opposes a bottom edge of the glass panel when the door is in the closed position.

In embodiments, the glass panel comprises a length parallel to the axis of rotation, and the filler panel comprises a length parallel to the axis of rotation that differs from the length of the glass panel by less than 5%. In embodiments, the door comprises a length parallel with the axis of rotation, and the length of the door differs from the length of the glass panel and the length of the filler panel by less than 5%. In embodiments, the glass panel further comprises a height that is orthogonal to the length of the glass panel. In embodiments, the filler panel further comprises a height that is orthogonal to the length of the filler panel, a portion of which height is disposed below the bottom edge of the glass panel when the door is in the closed position, and that portion of said height is within a range of 3% to 10% of the height of the glass panel.

In embodiments, the oven further comprises: a vent panel disposed below the door when the door is in the closed position. In embodiments, the door further comprises a bottom when the door is in the closed position. In embodiments, a distance separates the bottom of the door from the vent panel. In embodiments, the distance is a straight-line orthogonal to the axis of rotation. In embodiments, the distance has a maximum value of 7 mm or less.

In embodiments, a distance separating the axis of rotation from an exterior surface of the door facing the external environment is within a range of 3 mm to 9 mm. In embodiments, the distance is horizontal and orthogonal to the axis of rotation.

In embodiments, the oven further comprises: a second door disposed below the door when the door is in the closed position, the second door pivotally coupled to the base, the base further comprising second inner walls defining a second cooking chamber disposed below the cooking chamber and a second opening into the second cooking chamber. In embodiments, the door further comprises a bottom when the door is in the closed position. In embodiments, a distance separates the bottom of the door from the second door. In embodiments, the distance is a straight-line that is orthogonal to the axis of rotation. In embodiments, the distance has a maximum value of 7 mm or less.

According to another aspect of the present disclosure, an oven comprises: (1) a base comprising (i) inner walls defining a cooking chamber and an opening into the cooking chamber and (ii) second inner walls defining a second cooking chamber and a second opening into the second cooking chamber; (2) a first door pivotably coupled to the base via a hinge assembly attached to both the base and the first door, (a) the hinge assembly providing an axis of rotation about which the first door is movable relative to the base to, from, and between (i) an open position allowing access to the cooking chamber from an external environment through the opening and (ii) a closed position restricting access through the opening to the cooking chamber from the external environment, (b) the first door comprising a glass panel, the glass panel comprising a first primary surface and a second primary surface, the first primary surface being at least partially exposed to the external environment when the first door is in the closed position, and (c) the hinge assembly comprising a projection extending toward the external environment from the axis of rotation, when the first door is in the closed position, the second primary surface of the glass panel forming a plane that intersects with the projection of the hinge assembly; and (3) a second door pivotably coupled to the base via a second hinge assembly attached to both the base and the second door, (a) the second hinge assembly providing a second axis of rotation about which the second door is movable relative to the base to, from, and between (i) an open position allowing access to the second cooking chamber from an external environment through the second opening and (ii) a closed position restricting access through the second opening to the second cooking chamber from the external environment, (b) the second door comprising a second glass panel, the second glass panel comprising a first primary surface and a second primary surface, the first primary surface being at least partially exposed to the external environment when the second door is in the closed position, and (c) the second hinge assembly comprising a projection extending toward the external environment from the second axis of rotation, when the second door is in the closed position, the second primary surface of the second glass panel forming a plane that intersects with the projection of the second hinge assembly.

In embodiments, the first door further comprises a filler panel that is at least partially disposed below the glass panel when the first door is in the closed position, and the filler panel includes (i) a first primary surface that faces away from the axis of rotation and in a same direction as the first primary surface of the glass panel and (ii) a second primary surface that faces the axis of rotation and in a same direction as the second primary surface of the glass panel. In embodiments, the second door further comprises a second filler panel that is at least partially disposed below the second glass panel when the second door is in the closed position, and the second filler panel comprises (i) a first primary surface that faces away from the second axis of rotation and in a same direction as the first primary surface of the second glass panel and (ii) a second primary surface that faces the second axis of rotation and in a same direction as the second primary surface of the second glass panel. In embodiments, each of the filler panel and the second filler panel includes a recessed portion contiguous with the second primary surface, and the recessed portion accommodates the projection of the hinge assembly and the second hinge assembly respectively.

According to yet another aspect of the present disclosure, a door for an oven comprises: a hinge assembly providing an axis of rotation for the door; a glass panel, the glass panel comprising (i) a first primary surface providing an exterior surface of the door that is open to an external environment and (ii) a length parallel to the axis of rotation; and a filler panel disposed (i) at least partially below the glass panel and (ii) at least partially between the axis of rotation and a plane that the first primary surface of the glass panel forms, the filler panel comprising a length parallel to the axis of rotation, and the length of the filler panel differs from the length of the glass panel by less than 5%.

These and other features, advantages, and objects of the present disclosure will be further understood and appreciated by those skilled in the art by reference to the following specification, claims, and appended drawings.

Figure 1:
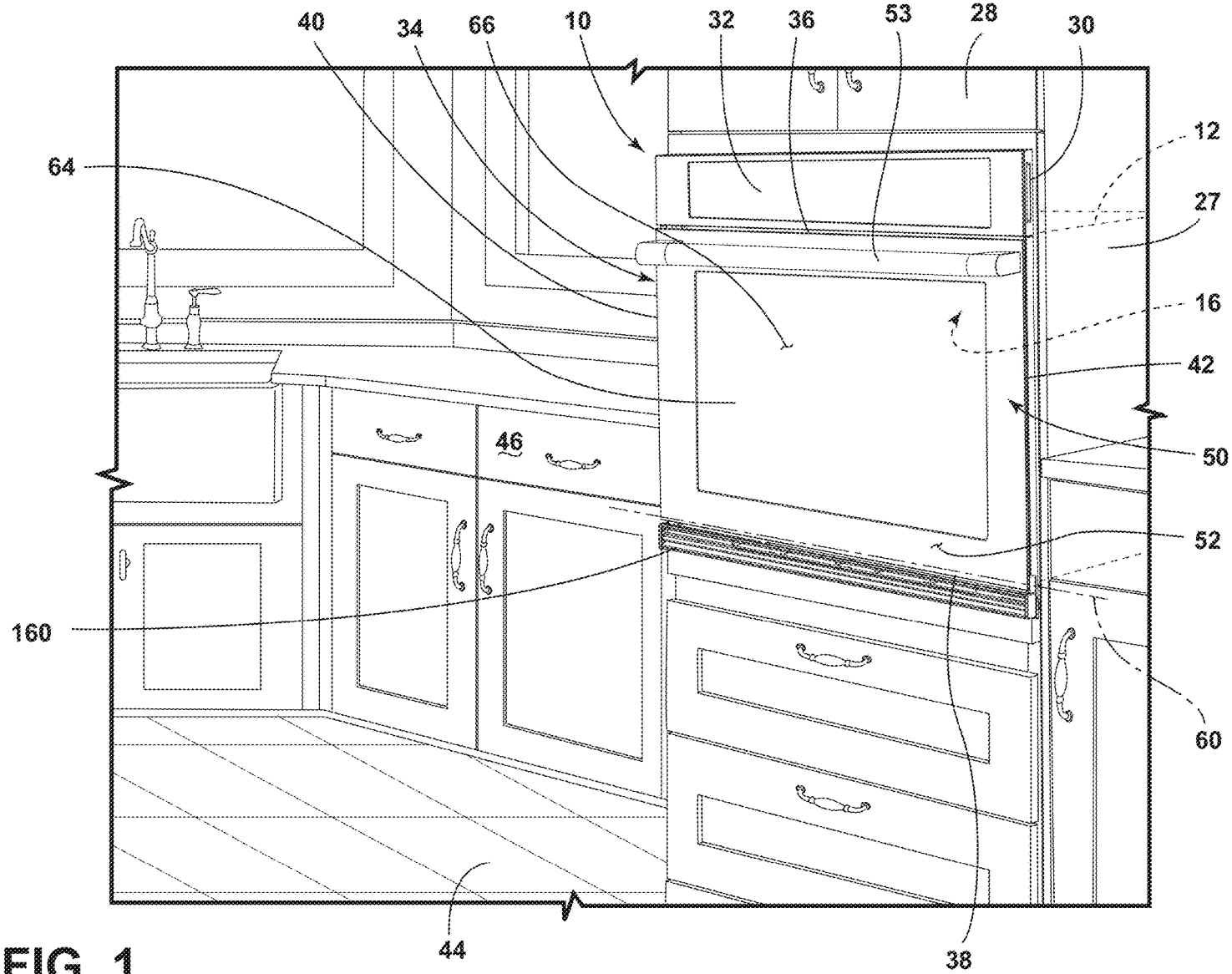
FIG. 1 illustrates an oven of the disclosure with a base set behind a wall and above cabinetry.

The components in the figures are not necessarily to scale, emphasis instead being placed upon illustrating the principles described herein.

DETAILED DESCRIPTION

The present illustrated embodiments reside primarily in combinations of method steps and apparatus components related to an oven. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

Figure 15:
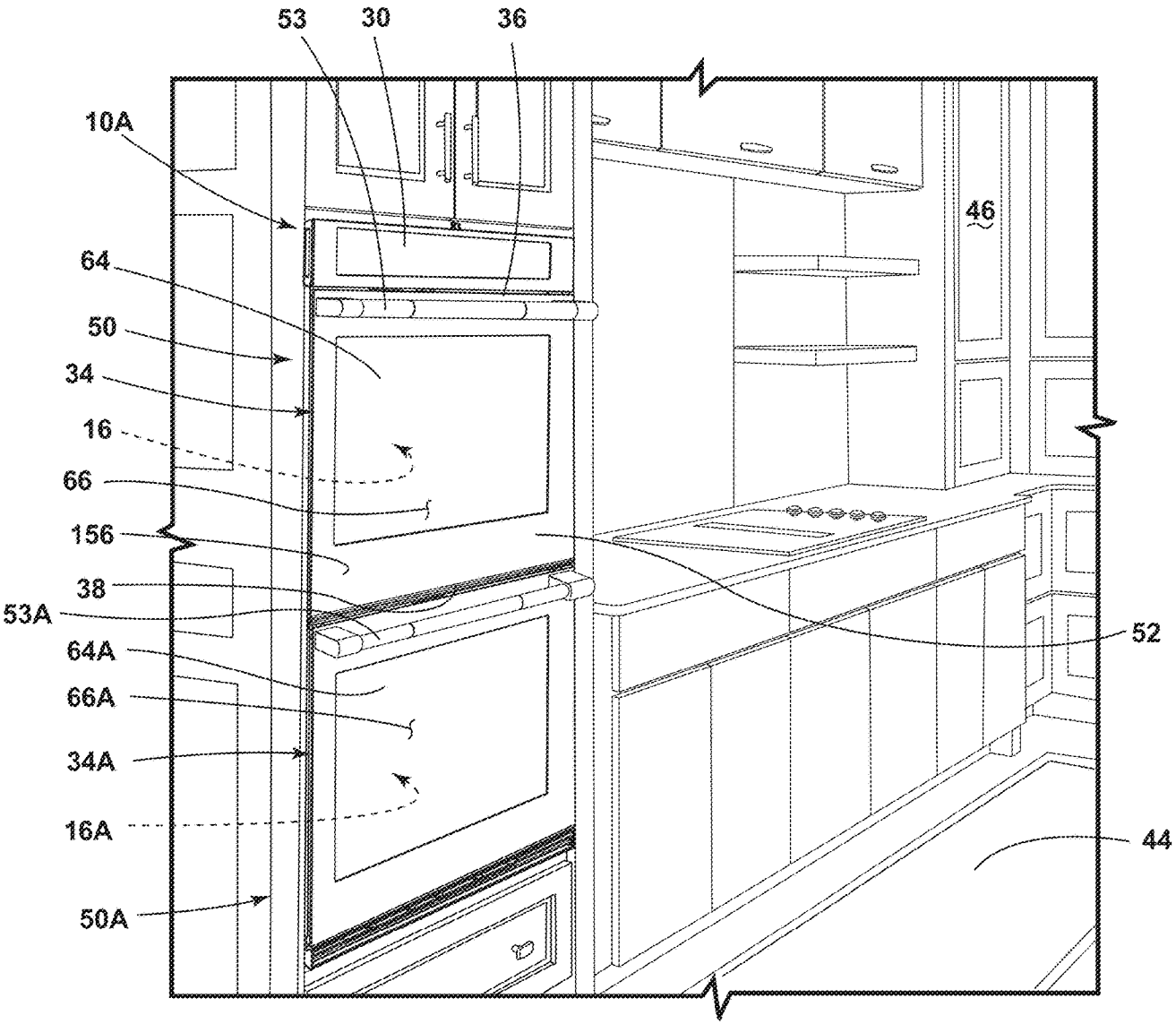
FIG. 15 illustrates the door of the oven of FIG. 1 but this time with a component of an oven with two doors (the door and a second door) and two cooking chambers.
Figure 16:
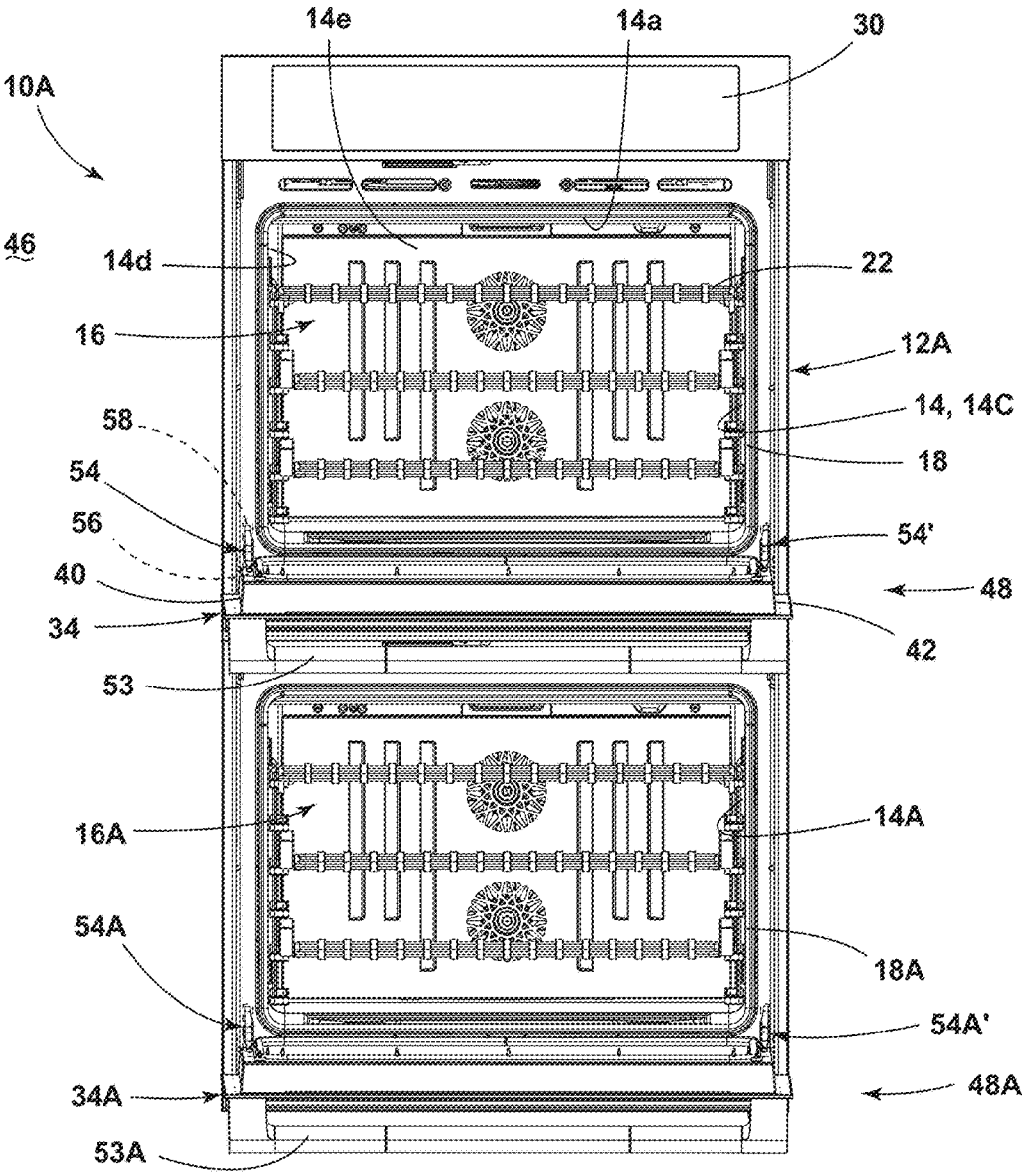
FIG. 16 is a front elevation view of the oven of FIG. 15, illustrating the door and the second door taking their respective open positions providing access to the two cooking chambers.
Figure 17:
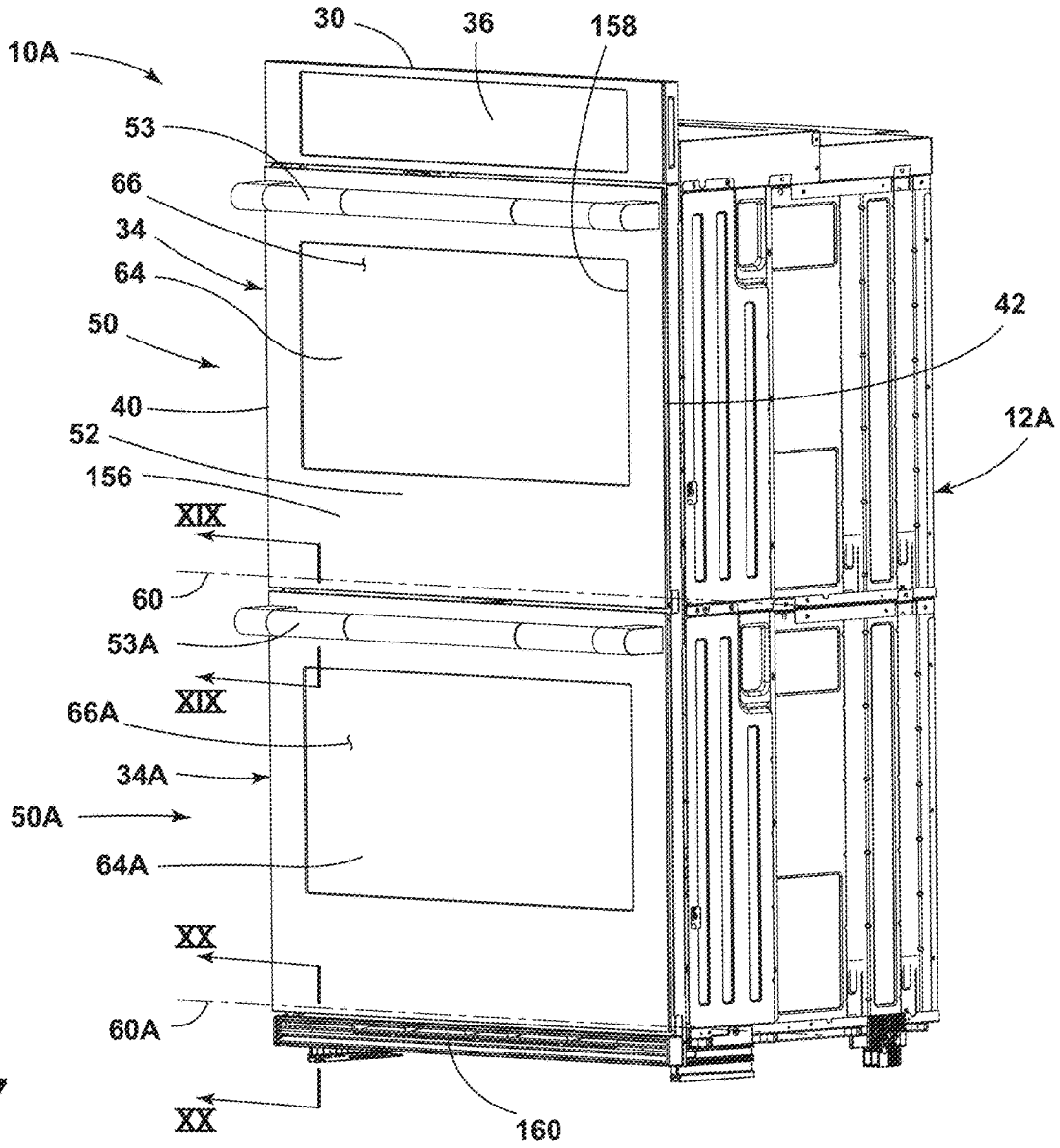
FIG. 17 is a perspective view of the oven of FIG. 15, illustrating the door and the axis of rotation for the door, the second door below the door, and the second axis of rotation for the second door.
Figure 18:
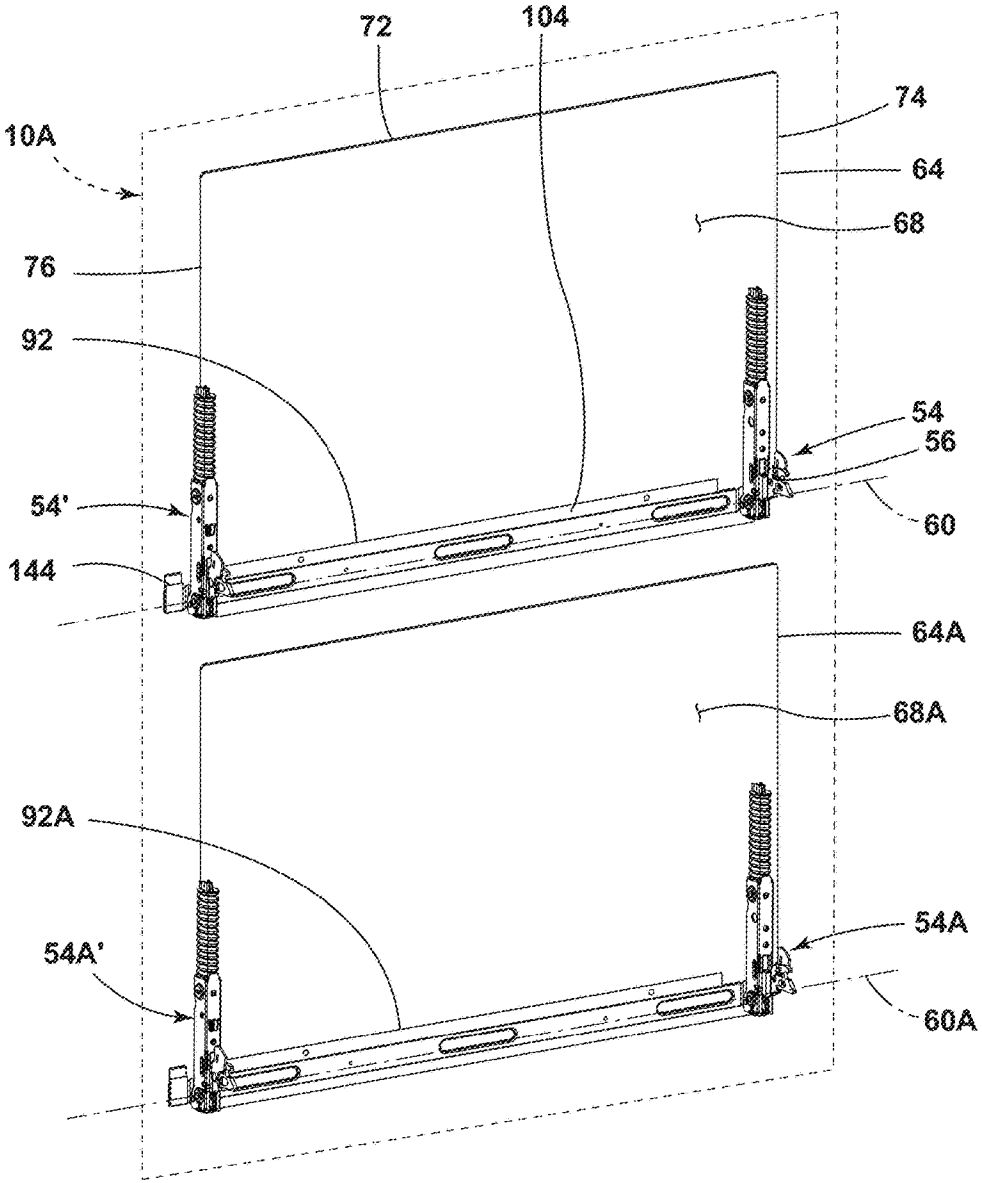
FIG. 18 is a rear perspective view of a portion of the door and the second door of the oven of FIG. 15, illustrating the glass panel of the door and the second door being identical to the door with the second door including a second glass panel and hinge assemblies providing the second axis of rotation.
Figure 19:
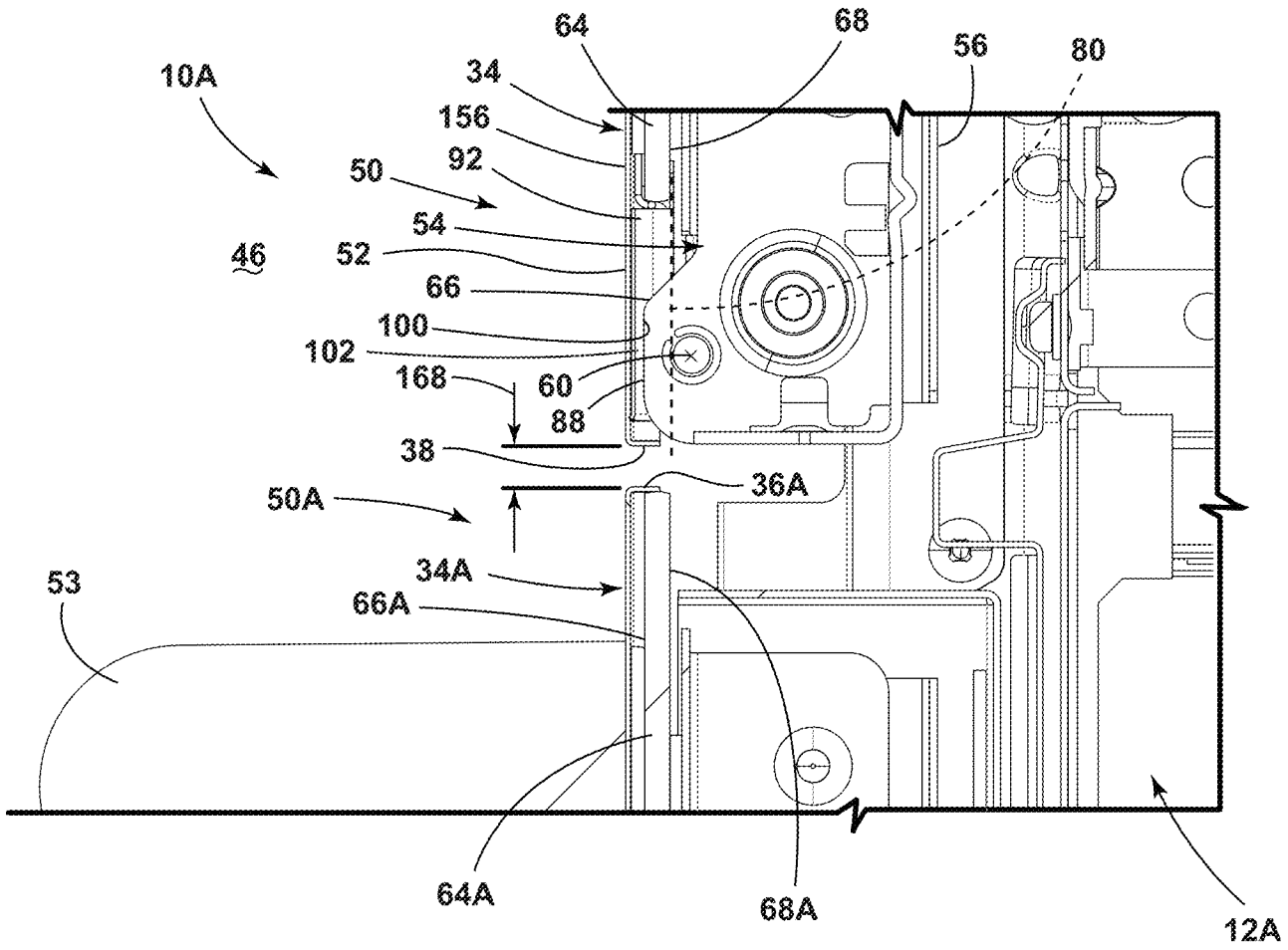
FIG. 19 is an elevation view of a cross-section of the oven of FIG. 15 taken along line XIX-XIX of FIG. 15, illustrating a distance separating the bottom of the door from a top of the second door, and the projection of the hinge assembly associated with the door extending beneath the glass panel and into the recessed portion of the filler panel, which is also disposed beneath the glass panel.
Figure 20:
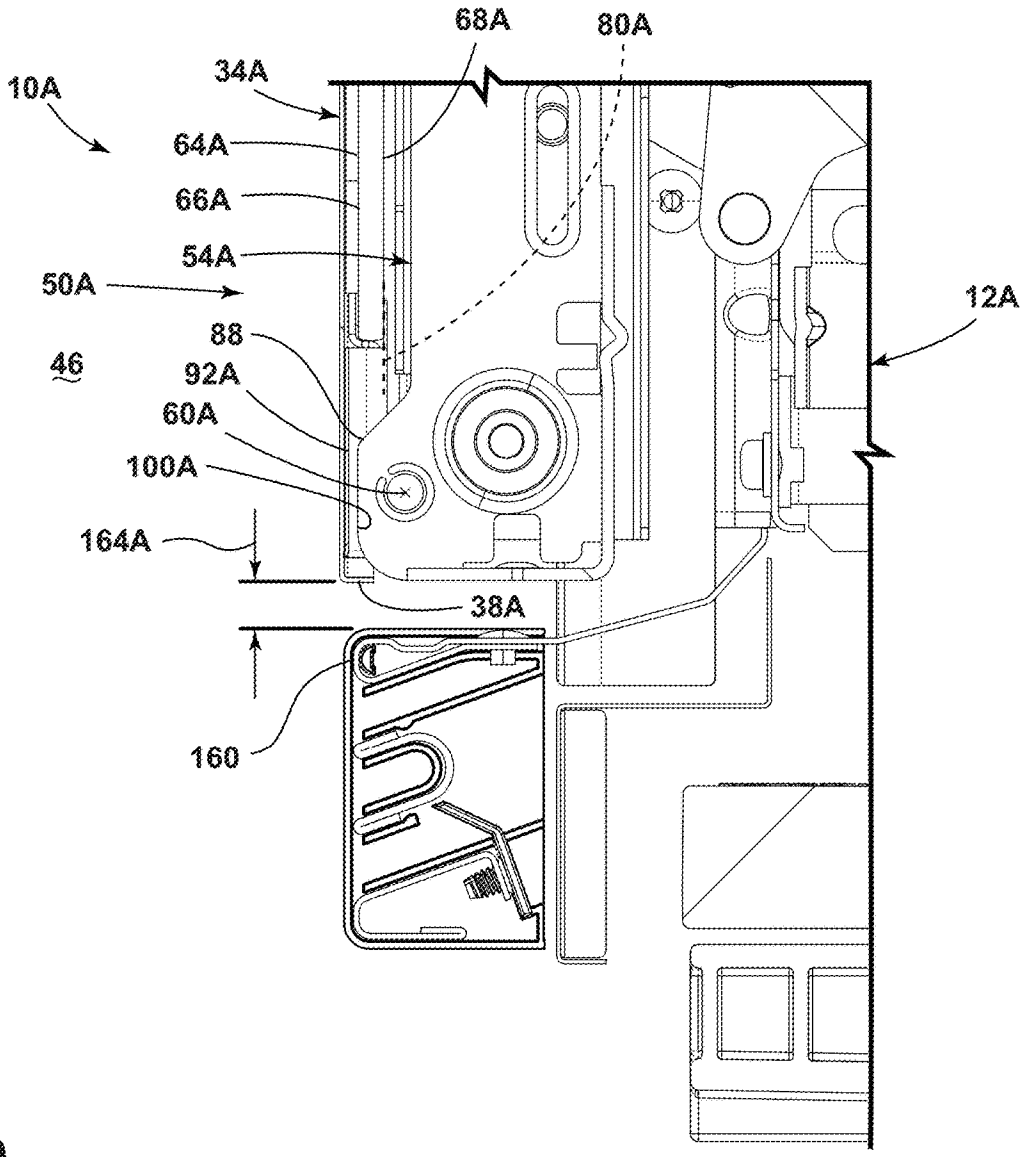
FIG. 20 is an elevation view of a cross-section of the oven of FIG. 15 taken along line XX-XX of FIG. 15, illustrating a distance separating the bottom of the second door from the vent panel.

For purposes of description herein, the terms "top," "bottom," "rear," "above," and "below" shall relate to the disclosure as oriented in FIGS. 1 and 15. Unless stated otherwise, the term "front" shall refer to the surface of the element closer to an intended user/viewer, and the term "rear" shall refer to the surface of the element further from the intended user/viewer. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprise the element.

Figure 2:
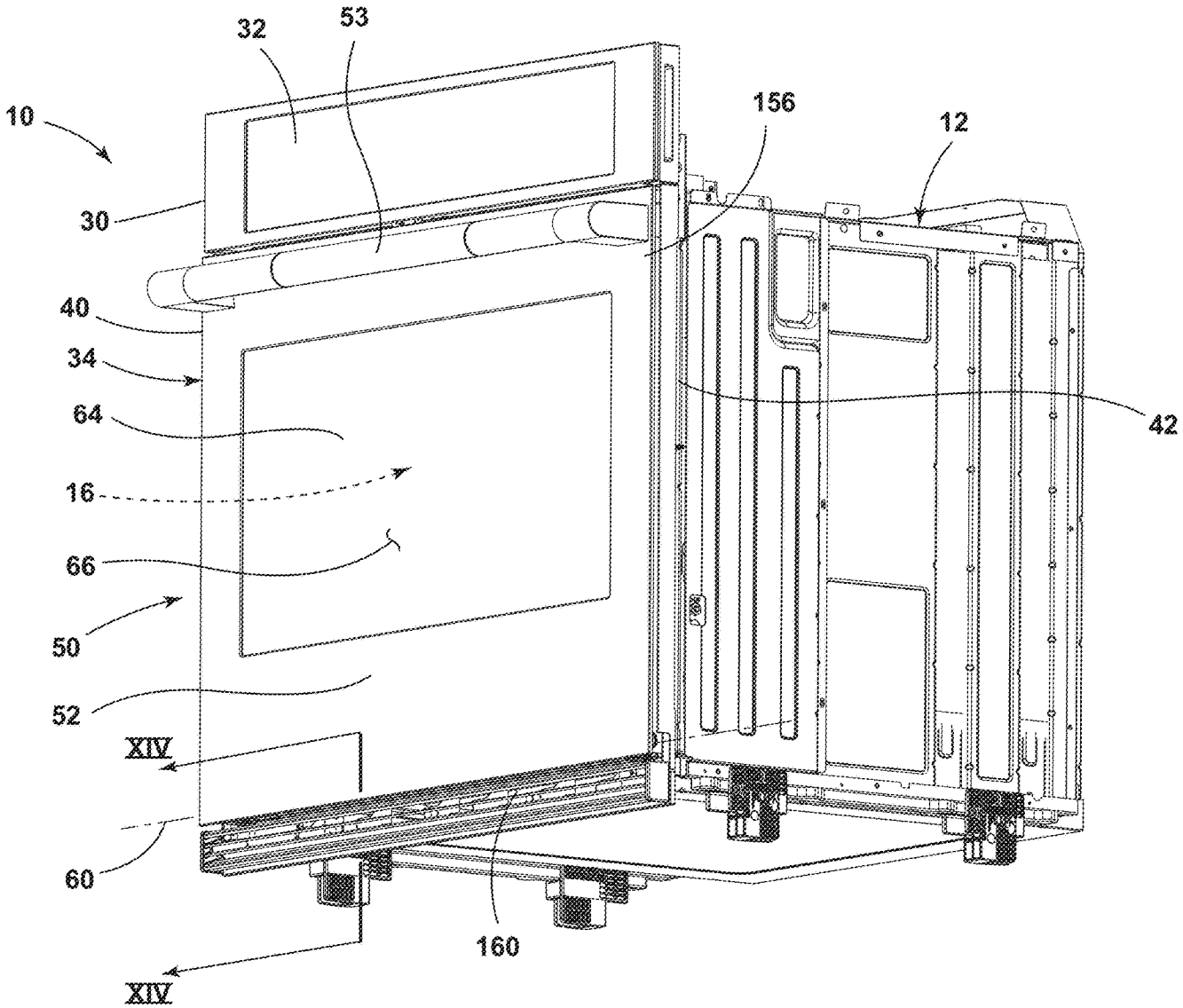
FIG. 2 is a perspective view of the oven of FIG. 1, illustrating the oven including a door in a closed position, and the door including a glass panel with a first primary surface that is exposed.
Figure 3:
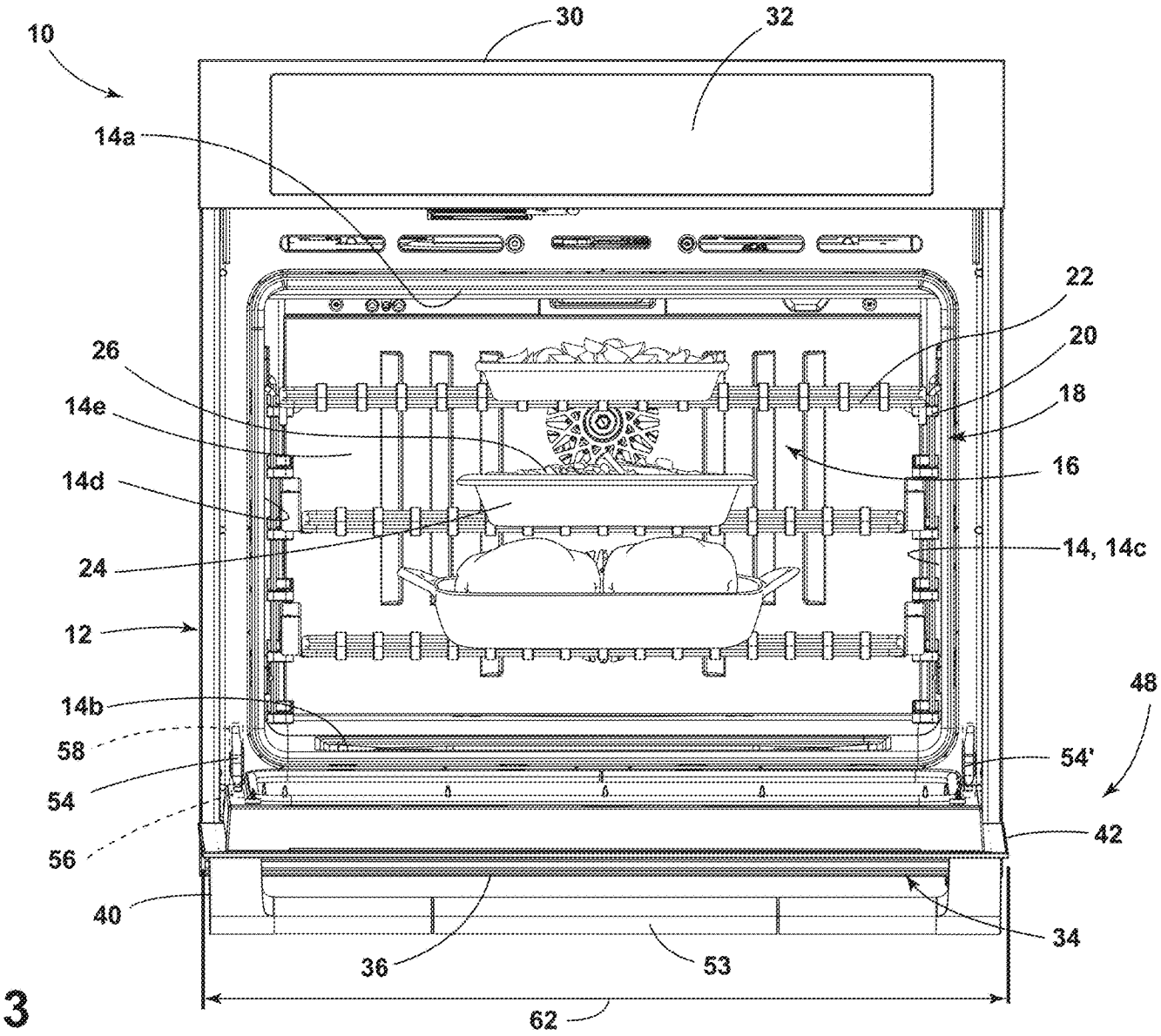
FIG. 3 is a front elevation view of the oven of FIG. 1, illustrating the door in an open position that allows access to a cooking chamber.

Referring to FIGS. 1-3, an oven 10 includes a base 12. The base 12 includes inner walls 14 that define a cooking chamber 16 and an opening 18 into the cooking chamber 16. The inner walls 14, in embodiments, include a top wall 14*a*, a bottom wall 14*b* opposing the top wall 14*a*, a side wall 14*c*, another side wall 14*d* opposing the side wall 14*c*, and a rear wall 14*e* that is generally orthogonal to the top wall 14*a*, the bottom wall 14*b*, the side wall 14*c*, the other side wall 14*d*, and the opening 18. The side wall 14*c* and the opposing side wall 14*d* can include cooperating projections 20 to support a slidable rack 22. The slidable rack 22 can support a container 24 of food 26 while being cooked at an elevated temperature within the cooking chamber 16 of the oven 10. In the embodiment illustrated, the oven 10 is the type commonly referred to as a "wall unit" or "wall oven," which is where the base 12 of the oven 10 is hidden from view behind a wall 27, cabinetry 28, and the like. However, in other embodiments, the oven 10 is not a wall oven and is a stand-alone oven, such as those commonly referred to as a "range." In embodiments, the oven 10 further includes a control panel 30, and the control panel 30 includes a user interface 32. The user interface 32 allows the user to command the oven 10 to perform functions related to cooking of the food 26 (e.g., temperature inside the cooking chamber 16, timer, etc.), as well as other functions, such as a pyrolytic self-cleaning function. The oven 10 can cook the food 26 via convention, conduction, microwave emission, and so on.

The oven 10 further includes a door 34. The door 34 has an open position 48 and a closed position 50. In the open position 48, the door 34 allows access to the cooking chamber 16 from the external environment 46 through the opening 18. However, in the closed position 50, the door 34 restricts access through the opening 18 to the cooking chamber 16 from the external environment 46.

The door 34 includes a top 36, a bottom 38, a first side 40, and a second side 42. The top 36 of the door 34 is the portion of the door 34 that is most elevated from a floor 44 of an external environment 46 to which the oven 10 is exposed, when the door 34 is in the closed position 50. The top 36 of the door 34 may be closer to the control panel 30 than the bottom 38, the first side 40, and the second side 42. The bottom 38 of the door 34 is the portion of the door 34 that is least elevated from the floor 44, when the door 34 is in the closed position 50. The first side 40 and the second side 42 generally mark the lateral extremes of the door 34, and transition between the top 36 of the door 34 and the bottom 38 of the door 34. The door 34 further includes an exterior surface 52 that faces the external environment 46 (e.g., a kitchen environment that a user of the oven 10 occupies). In embodiments, the door 34 includes a handle 53 upon which the user can hold to move the door 34 to, from, and between the open position 48 and the closed position 50.

Figure 4:
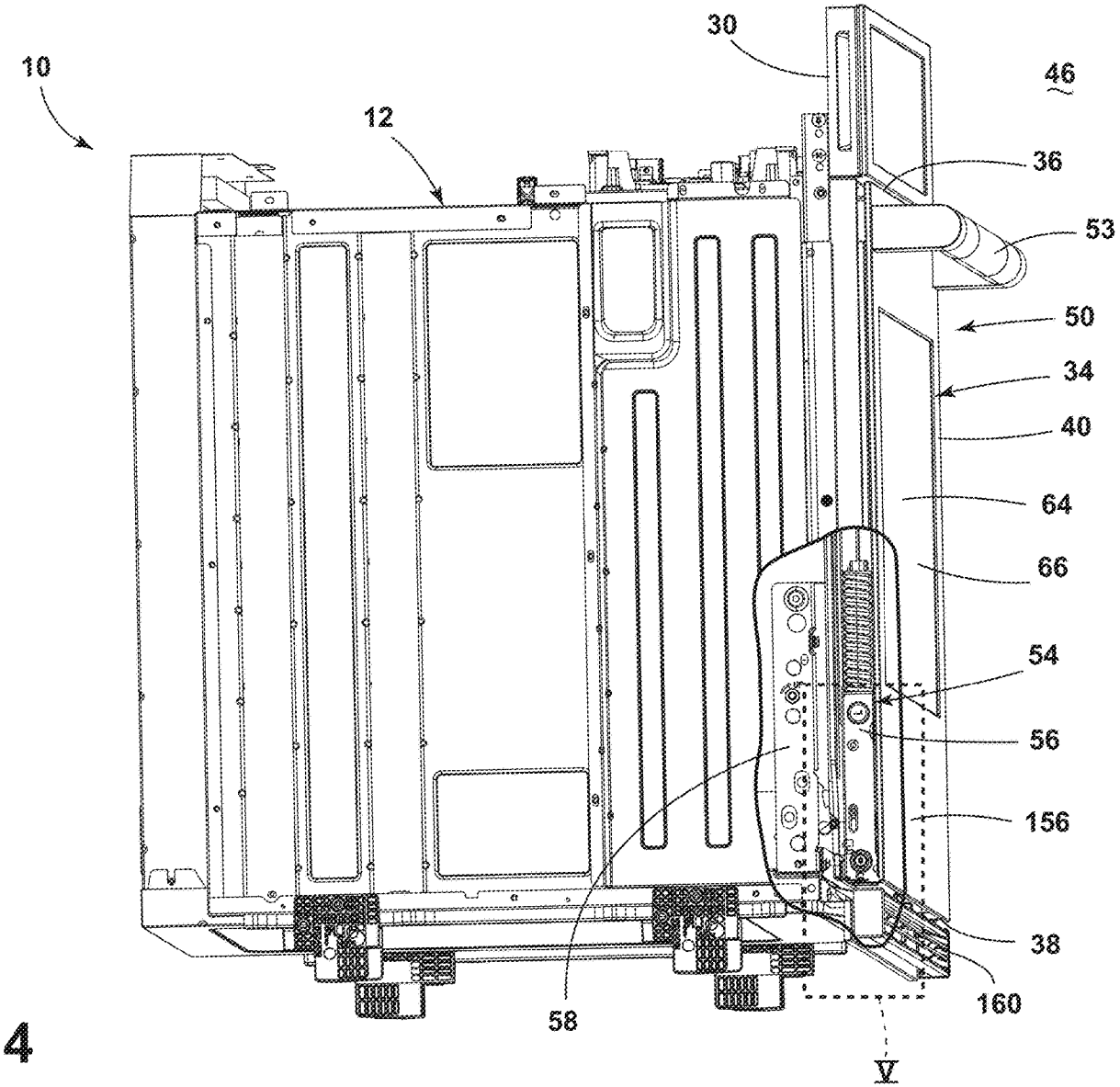
FIG. 4 is a side elevation view of the oven of FIG. 1 providing a see-through into the base and the door, illustrating a hinge assembly with a first portion attached to the door and a second portion attached to the base.
Figure 5:
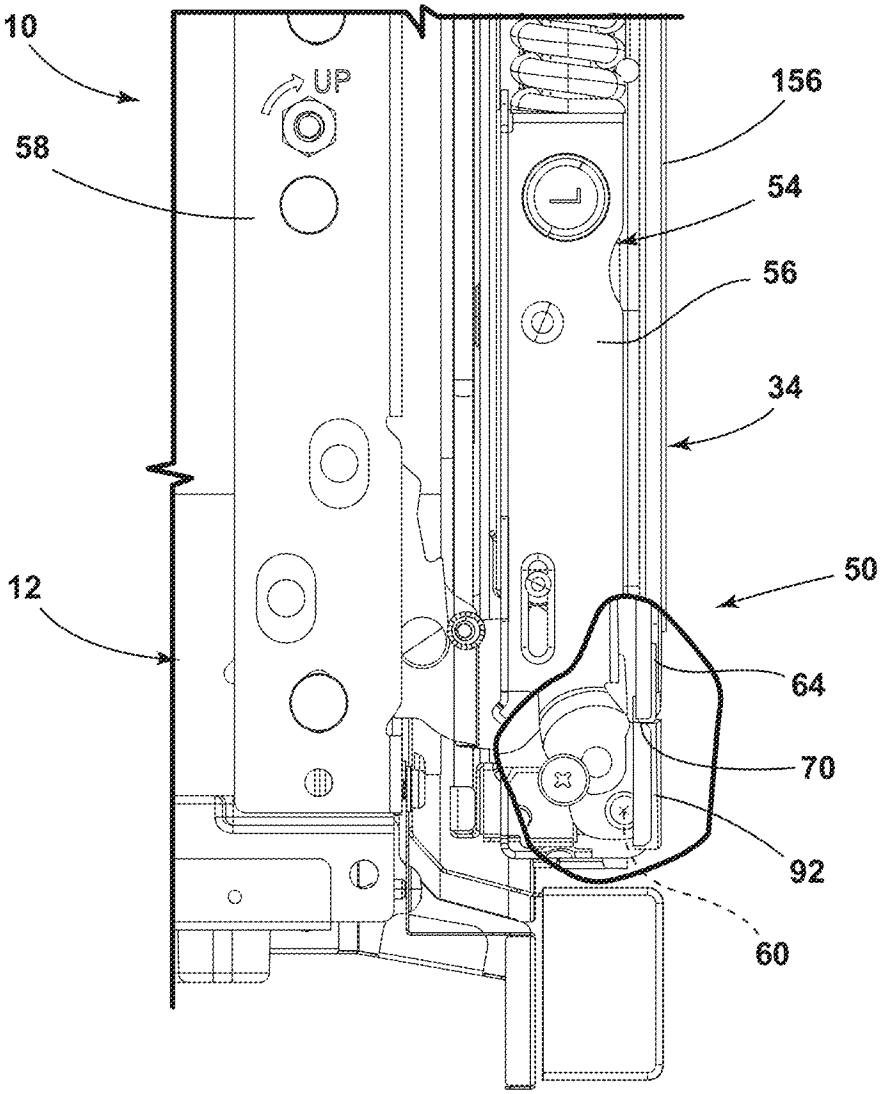
FIG. 5 is a close-up view of area V of FIG. 4 providing a see-through through a cover of the door and an external casing of the first portion of the hinge assembly, illustrating the first portion of the hinge assembly providing an axis of rotation for the door (to move to, from, and between the closed position and the open position), a filler panel between the axis of rotation and the cover, and the glass panel disposed above the filler panel.
Figure 6:
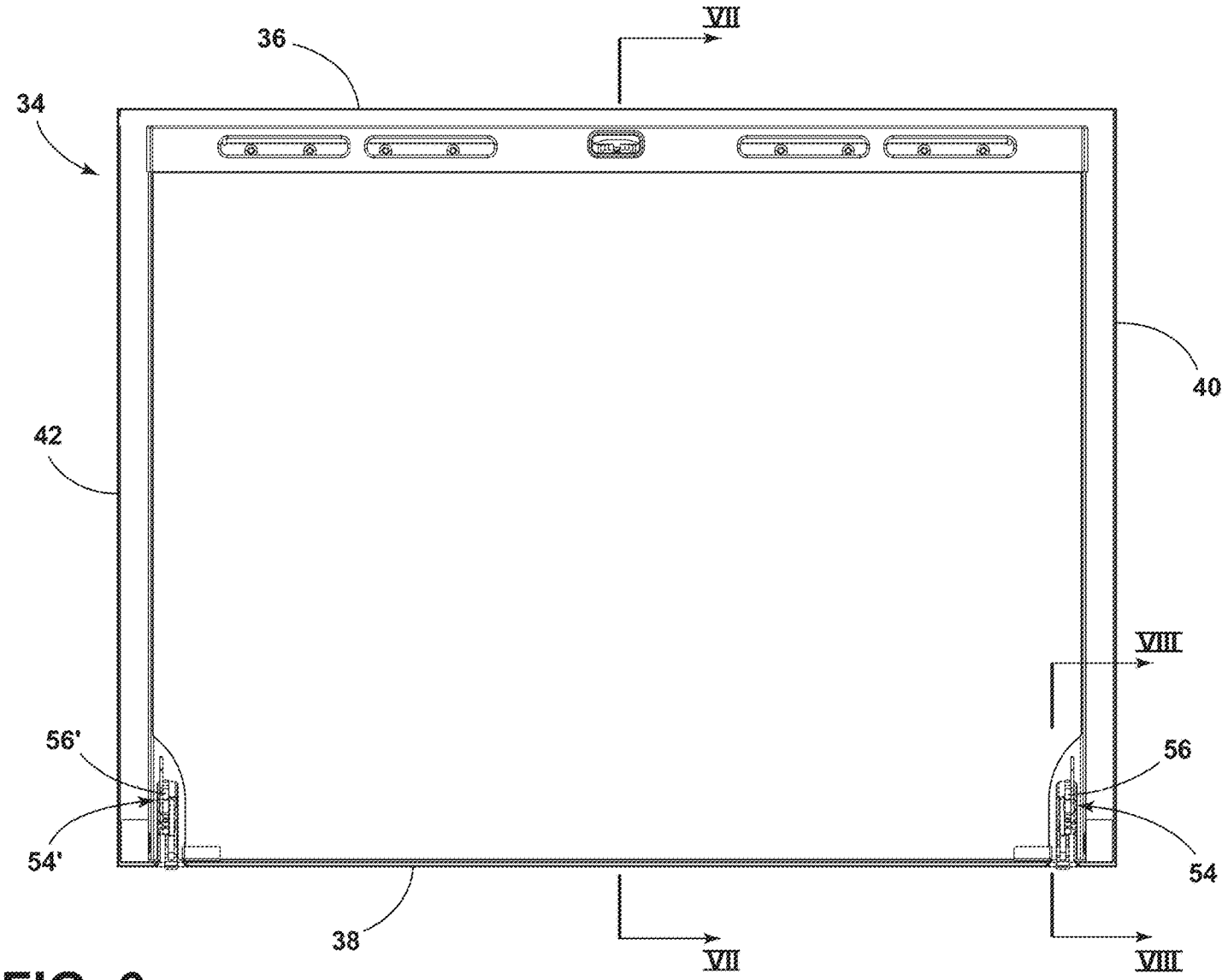
FIG. 6 is a rear elevation view of the door of the oven of FIG. 1, illustrating the first portion of the hinge assembly of FIGS. 4 and 5 disposed near a first side of the door and a first portion of another (identical) hinge assembly disposed near a second side of the door.
Figure 7:
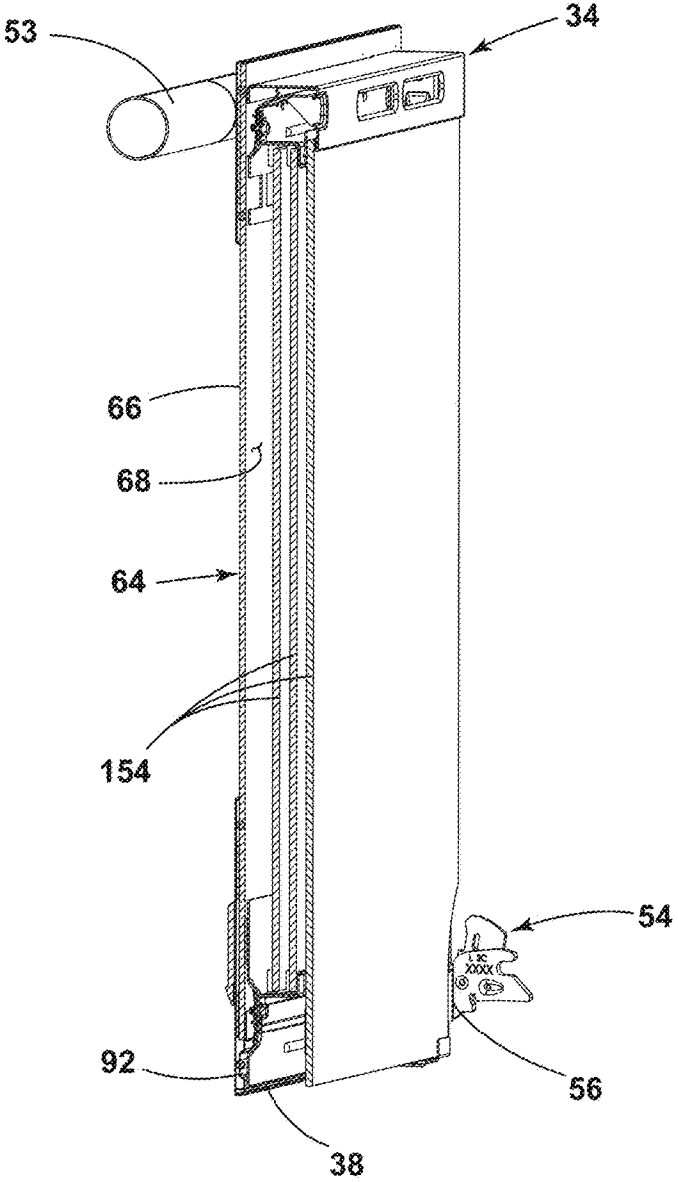
FIG. 7 is a perspective view of a cross-section of the door of the oven of FIG. 1 taken at line VII-VII of FIG. 6, illustrating the glass panel disposed above the filler panel, and the door further including several additional glass panels that are parallel to the glass panel with the exposed first primary surface.
Figure 8:
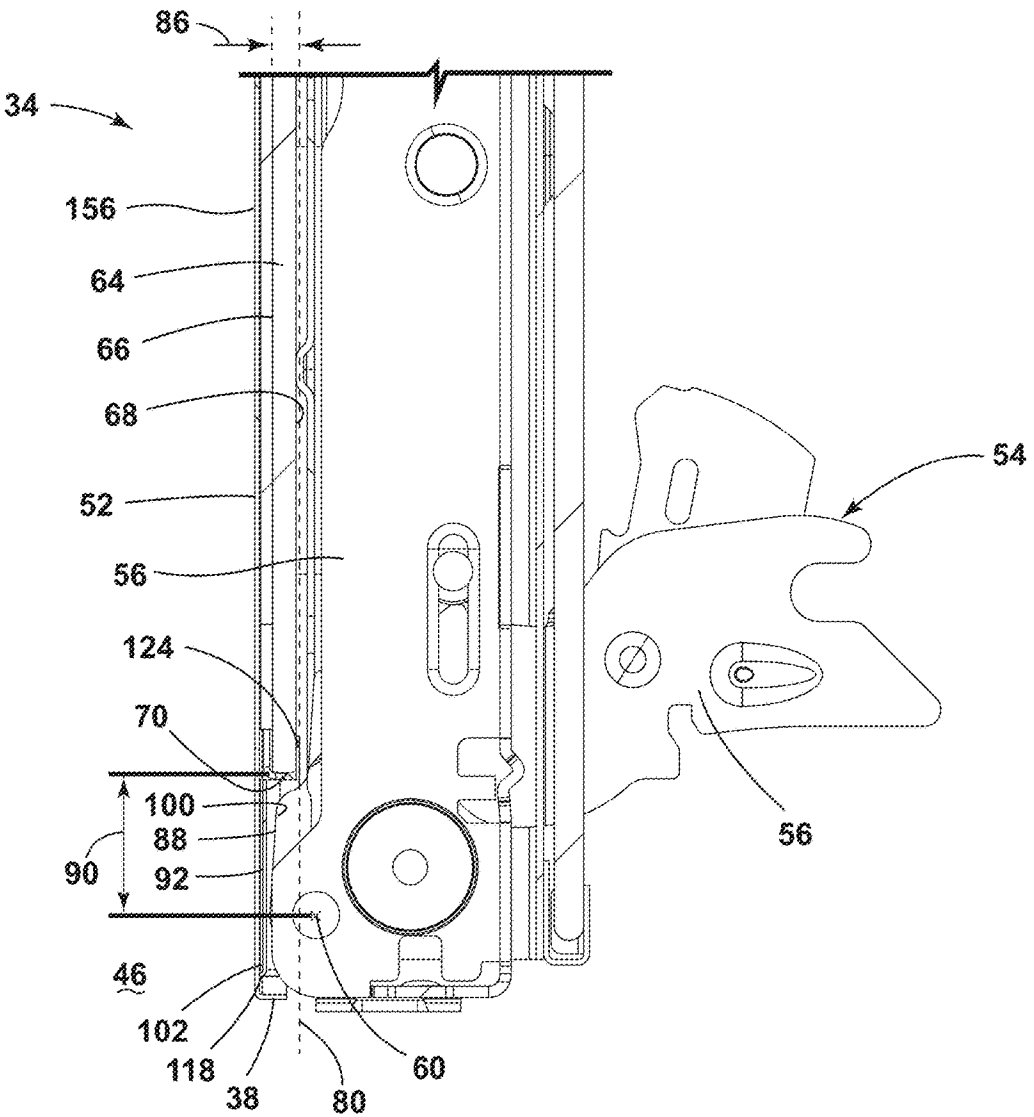
FIG. 8 is an elevation view of a cross-section of the door of the oven of FIG. 1 take at line VIII-VIII of FIG. 6, illustrating the first portion of the hinge assembly including a projection that projects toward the cover of the door (and thus the external environment) from the axis of rotation, and a plane that a second primary surface of the glass panel forms intersecting the projection, and a recessed portion of the filler panel disposed between the cover (and thus the external environment) and the axis of rotation.
Figure 9:
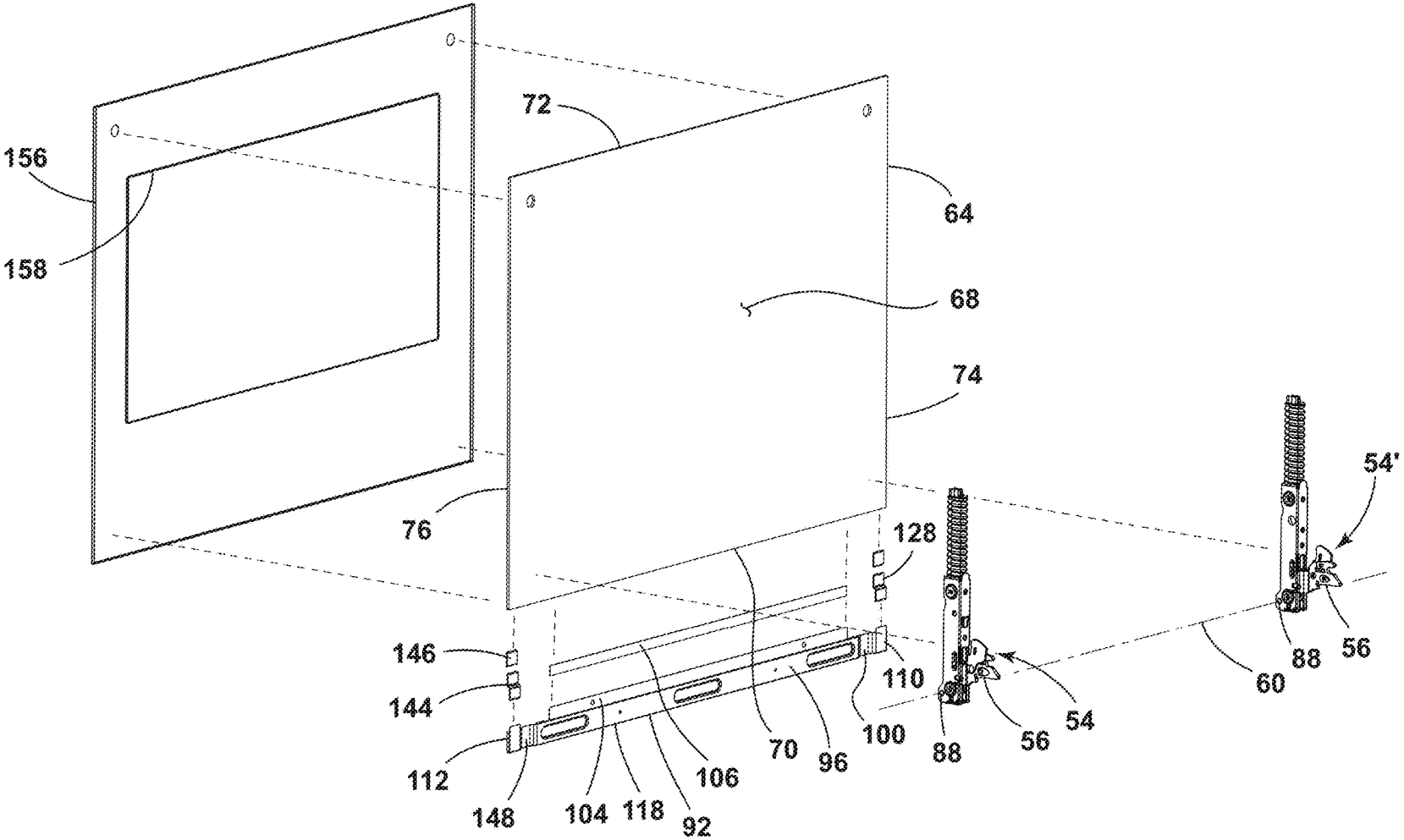
FIG. 9 is an exploded view of a portion of the door of the oven of FIG. 1, illustrating the glass panel, the filler panel, z-clips and adhesive tape that connect the glass panel to the filler panel, the cover partially encasing the glass panel and the filler panel, and the first portions of the hinge assemblies providing the axis of rotation.
Figure 10:
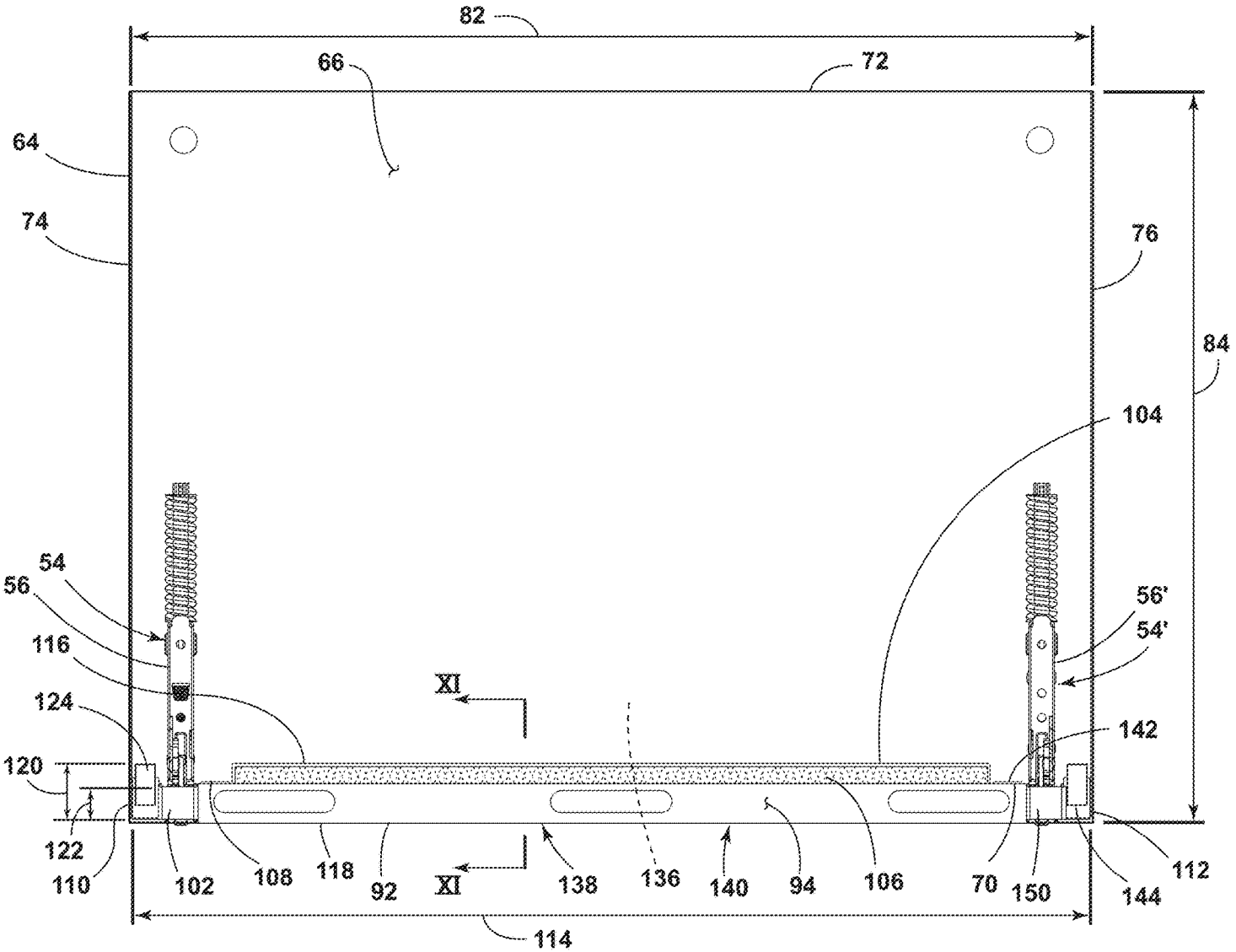
FIG. 10 is a front elevation view (that is viewing from the external environment toward the door) of the portion of the door illustrated in FIG. 9, illustrating the glass panel having a length from a first edge to a second edge, and the filler panel having a length from a first edge to a second edge that is the same or approximately the same as the length of the glass panel.
Figure 11:
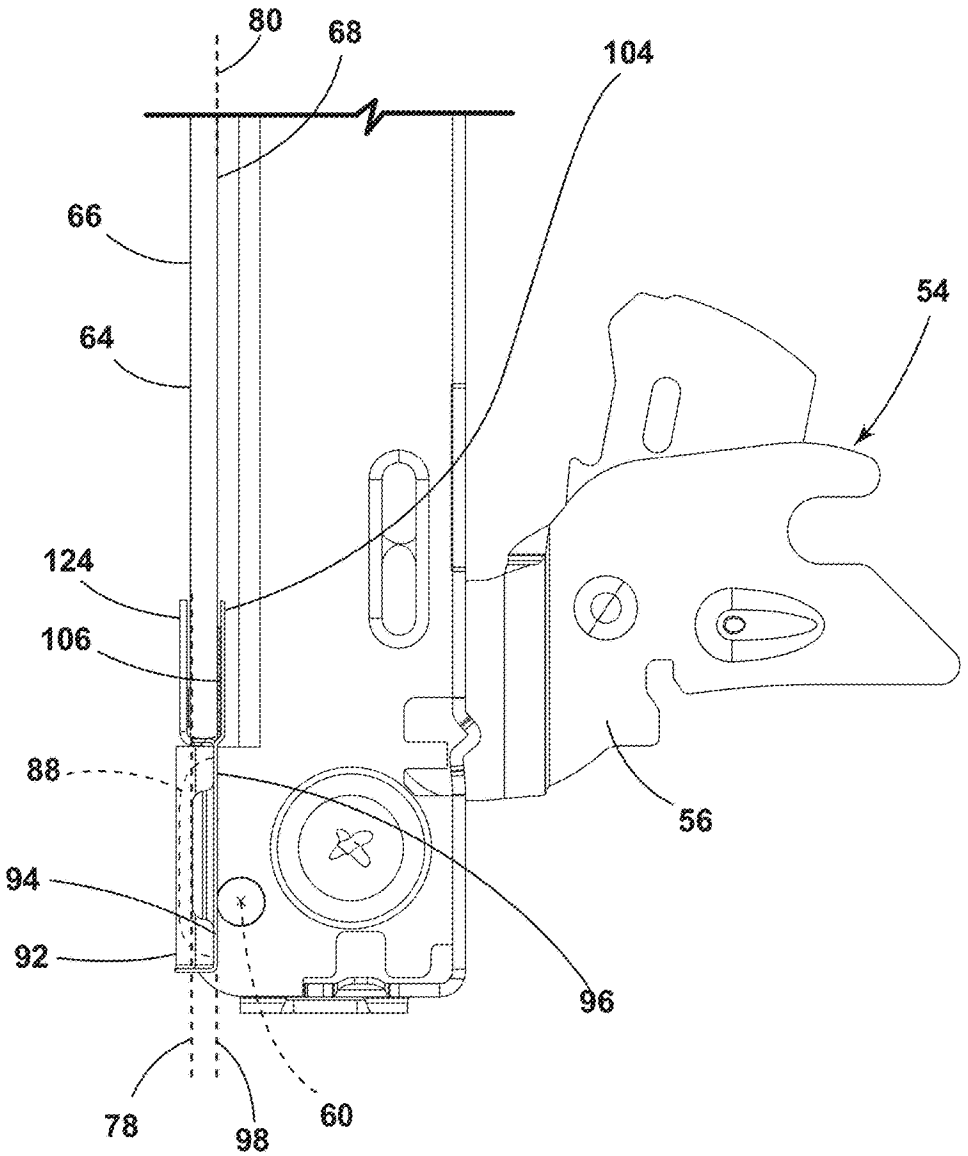
FIG. 11 is side elevation view of a cross-section taken through line XI-XI of FIG. 10, illustrating the filler panel having a first primary surface facing the exterior environment and a second primary surface facing the axis of rotation, and the projection of the first portion of the hinge assembly extending from the axis of rotation past a plane that the second primary surface of the filler panel forms.
Figure 12:
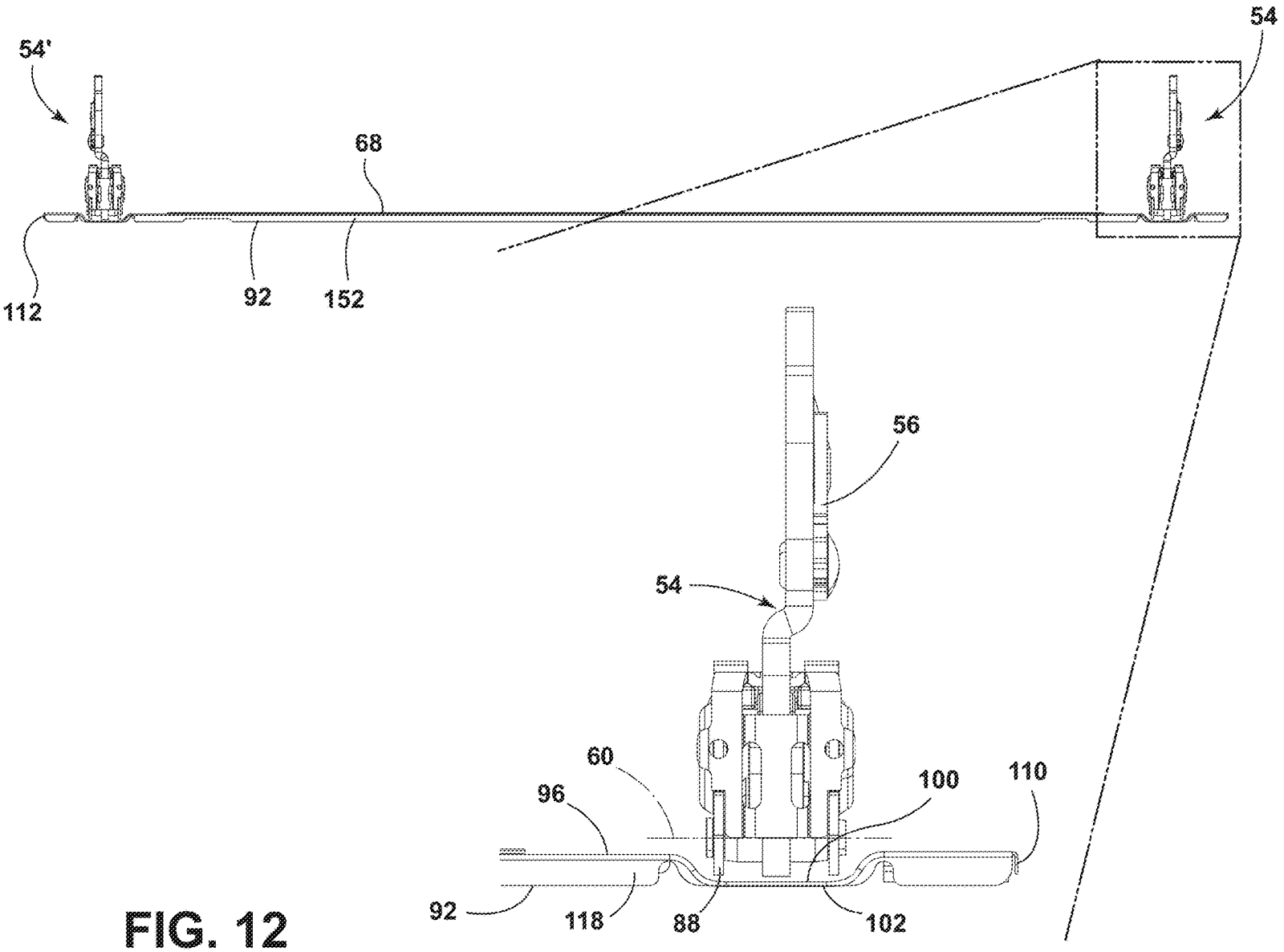
FIG. 12 is a bottom elevation view of the portion of the door illustrated in FIG. 9, illustrating the projection of the hinge assembly disposed between (i) the axis of rotation that the hinge assembly provides and (ii) the filler panel, with the recessed portion of the filler panel forming a contour contiguous with the second primary surface of the filler panel that accommodates the projection of the hinge assembly.
Figure 13:
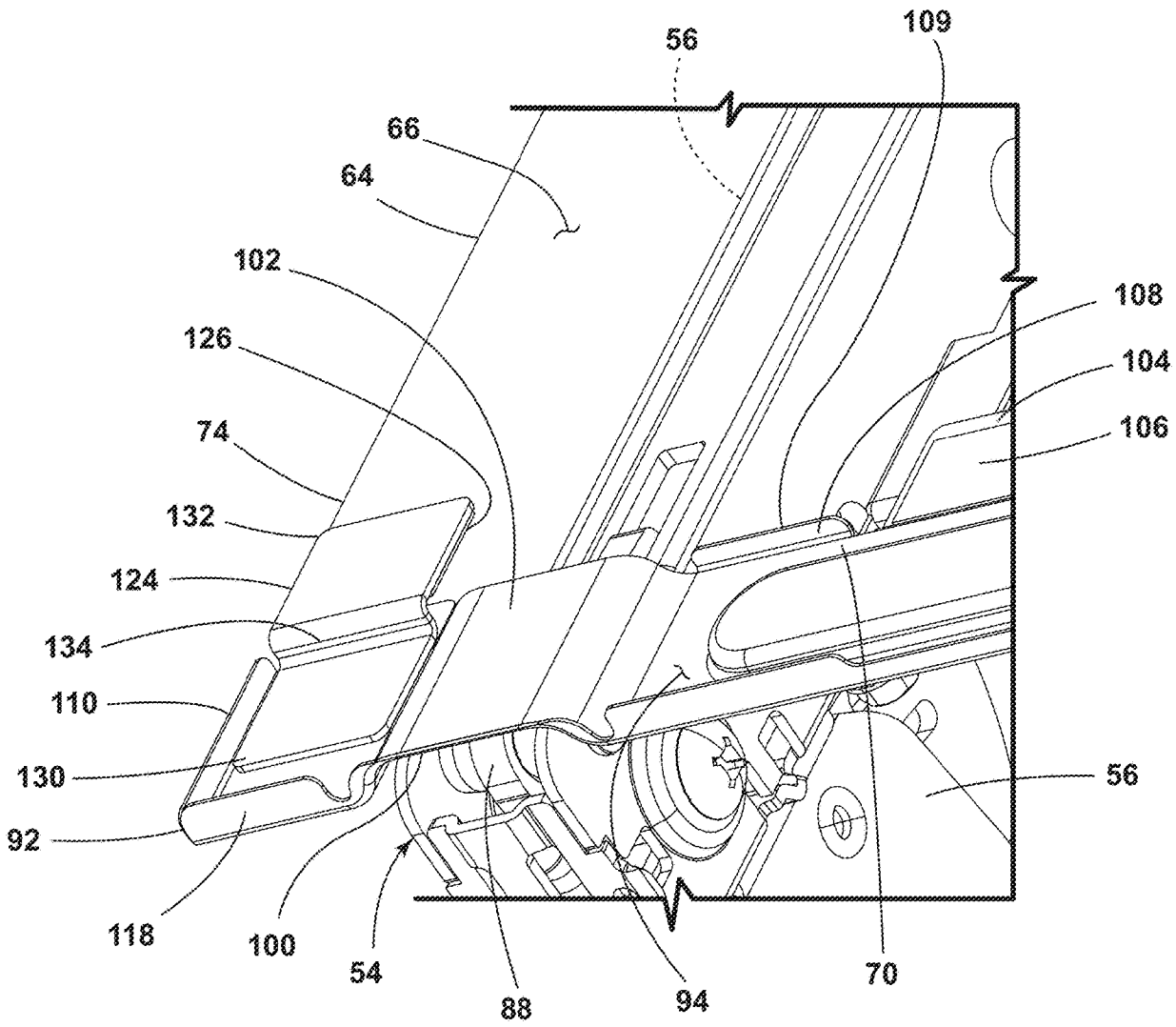
FIG. 13 is a bottom perspective view of the magnified area of FIG. 12, illustrating the filler panel having a horizontal tab that faces a bottom edge of the glass panel, and the z-clip with a bottom portion adhered to the first primary surface of the filler panel, a top portion forming a tab adhered to the first primary surface of the glass panel, and the recessed portion of the filler panel accommodating the projection of the hinge assembly.

Referring additionally to FIGS. 4 and 5, the door 34 is pivotally coupled to the base 12 via a hinge assembly 54. The hinge assembly 54 is attached to both the base 12 and the door 34. For example, in embodiments, the hinge assembly 54 includes a first portion 56 attached to the door 34 and a second portion 58 attached to the base 12. The hinge assembly 54 provides an axis of rotation 60 for the door 34. More specifically, the hinge assembly 54 provides the axis of rotation 60 about which the door 34 is movable relative to the base 12 to, from, and between the open position 48 and the closed position 50. In embodiments, such as the illustrated embodiments, the first portion 56 provides the axis of rotation 60. In embodiments, such as the illustrated embodiment, while moving from the closed position 50 to the open position 48, the door 34 pivots about the axis of rotation 60 in a generally downward direction, with the top 36 of the door 34 forming an arc of about 90 degrees. The movement of the door 34 from the closed position 50 to the open position 48 allows the user to insert and remove the container 24 with the food 26 into and from the cooking chamber 16. The movement of the door 34 from the open position 48 to the closed position 50 increases the efficiency of the cooking of the food 26, because the oven 10 is more able to maintain the elevated temperature within the cooking chamber 16 while the door 34 is in the closed position 50 compared to the open position 48. The door 34 has a length 62 that is parallel with the axis of rotation 60 extending between the first side 40 and the second side 42.

The oven includes an additional hinge assembly 54'. The hinge assembly 54 is disposed closer to the first side 40 of the door 34 than the hinge assembly 54'. The hinge assembly 54' is disposed closer to the second side 42 of the door 34 than the hinge assembly 54. The hinge assembly 54' provides the same axis of rotation 60 as the hinge assembly 54. The hinge assembly 54' is otherwise identical to hinge assembly 54. Thus, the discussion of the hinge assembly 54 applies equally to the hinge assembly 54' without the need for repetition.

Referring now additionally to FIGS. 6-11, the door 34 further comprises a glass panel 64. The glass panel 64 includes a first primary surface 66 and a second primary surface 68. The first primary surface 66 is at least partially exposed to the external environment 46 when the door 34 is in the closed position 50. That is, the first primary surface 66 of the glass panel 64 provides part of the exterior surface 52 of the door 34 that is exposed to the external environment 46. The glass panel 64 further includes a bottom edge 70 and a top edge 72. The bottom edge 70 is the least elevated, and the top edge 72 is the most elevated, when the door 34 is in the closed position 50. In embodiments, such as the embodiment illustrated, the glass panel 64 is generally rectangular and further includes a first edge 74 and a second edge 76. The first edge 74 is nearest the first side 40 of the door 34, and the second edge 76 is nearest the second side 42 of the door 34. The first primary surface 66 forms a plane 78, and the second primary surface 68 forms a plane 80, which planes 78, 80 extend infinitely. The glass panel 64 has a length 82 between the first edge 74 and the second edge 76 that is parallel with the axis of rotation 60. In addition, the glass panel 64 has a height 84 between the top edge 72 and the bottom edge 70. The height 84 is orthogonal to the axis of rotation 60 and the length 82 of the glass panel 64. The glass panel 64 has sufficient transparency to allow the user to see from the external environment 46, through the glass panel 64 when the door 34 is in the closed position 50, and into the cooking chamber 16. The glass panel 64 has a thickness 86 between the first primary surface 66 and the second primary surface 68. In embodiments, the thickness 86 is 10% or less of both the length 82 and the height 84 of the glass panel 64. In embodiments, the thickness 86 of the glass panel 64 is 10 mm or less, such as within a range of 1 mm to 10 mm.

The hinge assembly 54 includes a projection 88 that extends toward the external environment 46 from the axis of rotation 60 when the door 34 is in the closed position 50. The bottom edge 70 of the glass panel 64 faces the hinge assembly 54, specifically the projection 88 of the hinge assembly 54. The plane 80 that the second primary surface 68 of the glass panel 64 forms intersects with the projection 88. In embodiments, as in the illustrated embodiment, the bottom edge 70 of the glass panel 64 is entirely more elevated than the axis of rotation 60 when the door 34 is in the closed position 50. In embodiments, the bottom edge 70 of the glass panel 64 is elevated a distance 90 within a range of 10 mm to 25 mm relative to the axis of rotation 60.

Referring additionally to FIGS. 11-14, the door 34 further comprises a filler panel 92. The filler panel 92 is at least partially disposed below the glass panel 64 when the door 34 is in the closed position 50. In addition, the filler panel 92 is at least partially disposed between the axis of rotation 60 and the plane 78 that the first primary surface 66 of the glass panel 64 forms. For example, the filler panel 92 includes a first primary surface 94 and a second primary surface 96. The first primary surface 94 faces away from the axis of rotation 60 and in a same direction as the first primary surface 66 of the glass panel 64—that is, toward the external environment 46. The second primary surface 96 faces the axis of rotation 60 and in a same direction as the second primary surface 68 of the glass panel 64—that is, away from the exterior surface 52 of the door 34. The first primary surface 94 and the second primary surface 96 of the filler panel 92 are at least partially disposed between the plane 78 that the first primary surface 66 of the glass panel 64 forms and the axis of rotation 60. The second primary surface 96 of the filler panel 92 forms a plane 98 that intersects with the projection 88 of the hinge assembly 54. In other words, at least a portion of the projection 88 of the hinge assembly 54 is disposed further from the axis of rotation 60 than the second primary surface 96 of the filler panel 92. However, the filler panel 92 includes a recessed portion 100 that is contiguous with the second primary surface 96. The recessed portion 100 accommodates the projection 88 of the hinge assembly 54. In other words, although the projection 88 of the hinge assembly 54 extends further from the axis of rotation 60 than the second primary surface 96 of the filler panel 92, the recessed portion 100 that is contiguous with the second primary surface 96 projects even further from the axis of rotation 60 than the projection 88 of the hinge assembly 54, such that the filler panel 92 contours around the projection 88.

In embodiments, the filler panel 92 comprises sheet metal (such as stainless steel) that is stamped. Thus, the stamping that forms the recessed portion 100 into the second primary surface 96 additionally forms a projection 102 out of the first primary surface 94 of the filler panel 92 that extends further away from the axis of rotation 60 than the first primary surface 94 of the filler panel 92.

The filler panel 92 further includes a vertical tab 104 that extends vertically, when the door 34 is in the closed position 50, and that faces the second primary surface 68 of the glass panel 64. The door 34 further includes a double-sided adhesive strip 106 that is adhered to both the vertical tab 104 of the filler panel 92 and the second primary surface 68 of the glass panel 64. The double-sided adhesive strip 106 thus connects the filler panel 92 to the glass panel 64. The filler panel 92 can be connected to the glass panel 64 in other ways, such as with fasteners and clips, instead of the double-sided adhesive strip 106.

The filler panel 92 further includes a horizontal tab 108 that is horizontal when the door 34 is in the closed position 50, and that opposes the bottom edge 70 of the glass panel 64. In embodiments, the horizontal tab 108 is inboard of the projection 88 and is contiguous with the first primary surface 94 and the second primary surface 96 of the filler panel 92. The horizontal tab 108 extends away from the axis of rotation 60 and generally orthogonally relative to the first primary surface 94 and the second primary surface 96 of the filler panel 92. The horizontal tab 108 can abut the bottom edge 70 of the glass panel 64.

The filler panel 92 has a first edge 110 and a second edge 112. The first edge 110 and the second edge 112 are the lateral extremes of the filler panel 92 when oriented generally parallel with the axis of rotation 60. The first edge 110 is closest to the first side 40 of the door 34. The second edge 112 is closest to the second side 42 of the door 34. The filler panel 92 has a length 114 between the first edge 110 and the second edge 112 that is parallel to the axis of rotation 60. In embodiments, the length 114 of the filler panel 92 is the same as the length 82 of the glass panel 64, subject to manufacturing tolerances. In embodiments, the length 114 of the filler panel 92 is within 5 mm, 4 mm, 3 mm, 2 mm, or 1 mm of the length 82 of the glass panel 64. In embodiments, the length 114 of the filler panel 92 differs from the length 82 of the glass panel 64 by less than 5%. For example, if the length 82 of the glass panel 64 is 100 mm, then the length 114 of the filler panel 92 differs by less than 5 mm (because 5% of 100 mm is 5 mm). Similarly, in embodiments, the length 62 of the door 34 differs from the length 82 of the glass panel 64 and the length 114 of the filler panel 92 by less than 5%.

The filler panel 92 further includes a top edge 116 and a bottom edge 118. The top edge 116 is most elevated when the door 34 is in the closed position 50. In embodiments, the vertical tab 104 provides the top edge 116. The bottom edge 118 is least elevated when the door 34 is in the closed position 50. The filler panel 92 has a height 120 between the top edge 116 and the bottom edge 118, and the height 120 is orthogonal to the length 114 of the filler panel 92. A portion 122 of the height 120 is disposed below the bottom edge 70 of the glass panel 64 when the door 34 is in the closed position 50, such as a top 109 of the horizontal tab 108 to the bottom edge 118 of the filler panel 92. In embodiments, the portion 122 of the height 120 of the filler panel 92 is within a range of 3% to 10% of the height 84 of the glass panel 64. For example, if the height 84 of the glass panel 64 is 100 mm, then the portion 122 of the height 120 of the filler panel 92 disposed below the bottom edge 70 of the glass panel 64 when the door 34 is in the closed position 50 is within the range of 3 mm to 10 mm.

The filler panel 92 further includes another vertical tab 124 that extends vertically, when the door 34 is in the closed position 50, and faces the first primary surface 66 of the glass panel 64. The vertical tab 124 is disposed closer to the first edge 110 of the filler panel 92 than the recessed portion 100 and the projection 102 that accommodates the projection 88 of the hinge assembly 54. A double-sided adhesive strip 126 can be disposed between the vertical tab 124 and the first primary surface 66 of the glass panel 64 to adhere the vertical tab 124 to the glass panel 64. In embodiments, a z-clip 128 provides the vertical tab 124. The z-clip 128 includes a bottom portion 130 that is adhered to the first primary surface 94 of the filler panel 92. The z-clip 128 further includes a top portion 132 that provides the vertical tab 124 that is adhered to the first primary surface 66 of the glass panel 64. The z-clip 128 further includes a transition 134 that positions the top portion 132 of the z-clip 128 further away from the axis of rotation 60 than the bottom portion 130. The transition 134 thus faces the bottom edge 70 of the glass panel 64. The top portion 132 of the z-clip 128 facing the glass panel 64 is planar, as is the bottom portion 130 facing the filler panel 92.

In embodiments, the filler panel 92 has a midline 136 that conceptually divides the length 114 of the filler panel 92 into two symmetrical halves 138, 140. The first edge 110 is at the half 138. The second edge 112 is at the half 140. The vertical tab 104 extends from the midline 136 into both halves 138, 140 equidistantly. The recessed portion 100, the projection 102, the horizontal tab 108, and the z-clip 128, attached to the filler panel 92 via the double-sided adhesive strip 126 and providing the vertical tab 124, are all disposed at half 138 closer to the hinge assembly 54. The filler panel 92 further includes matching components disposed at the half 140 closer to the other hinge assembly 54', specifically a horizontal tab 142, a z-clip 144 providing a vertical tab 146, a recessed portion 148, and a projection 150. Like names mean like orientation and positioning, including with respect to the other hinge assembly 54'. For instance, the recessed portion 148 contours around the projection 88 of the other hinge assembly 54'. The filler panel 92 can include other features, such as tab 152, to improve structural stability.

In embodiments, the door 34 further includes one or more other glass panels 154 disposed between the glass panel 64 and the cooking chamber 16 when the door 34 is in the closed position 50. The one or more other glass panels 154 are sufficiently transparent and aligned to allow the user to see from the external environment 46, through the glass panel 64, the one or more other glass panels 154, and into the cooking chamber 16. The one or more other glass panels 154 can be parallel to the glass panel 64.

In embodiments, the door 34 further includes a cover 156 partially encasing the glass panel 64 and the filler panel 92. The cover 156 is disposed between the external environment 46 and the glass panel and the filler panel 92. The cover 156 provides part of the exterior surface 52 of the door 34. The cover 156 faces the first primary surface 66 of the glass panel 64 and the first primary surface 94 of the filler panel 92. However, the cover 156 has a window 158 through to the first primary surface 66 of the glass panel 64.

Figure 14:
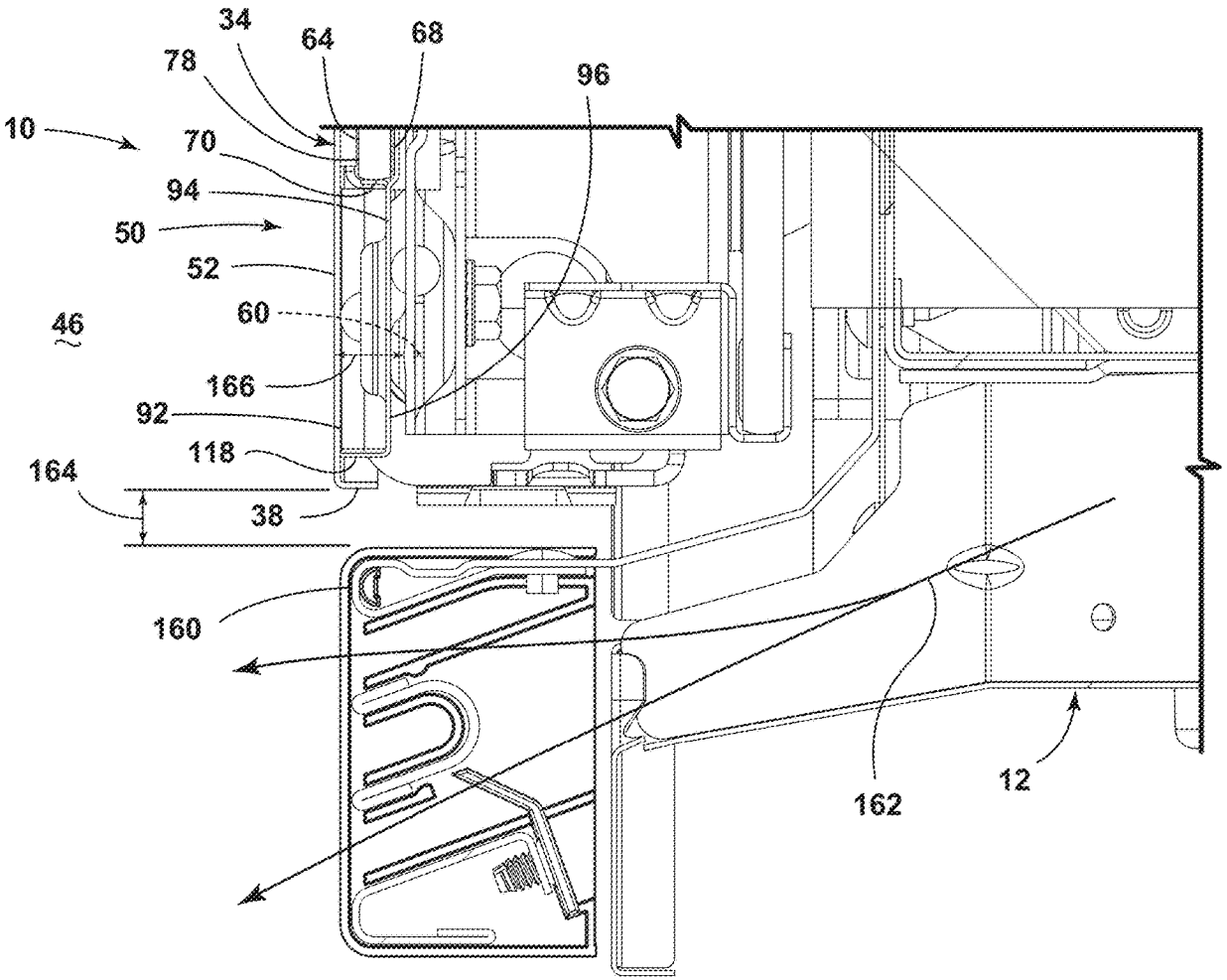
FIG. 14 is an elevation view of a cross-section of the oven of FIG. 1 taken along line XIV-XIV of FIG. 2, illustrating a distance that is horizontal separating the axis of rotation from the exterior surface of the door facing the external environment, and a distance separating the bottom of the door from a vent panel of the oven disposed below the bottom of the door.

Referring more particularly to FIG. 14, the oven 10 further includes a vent panel 160. The vent panel 160 is disposed below the door 34, when the door 34 is in the closed position 50. Air flows from within the oven 10 along a path 162 below the vent panel 160 and into the external environment 46. A distance 164 separates the bottom 38 of the door 34 from the vent panel 160. The distance 164 is a straight-line orthogonal to the axis of rotation 60. In embodiments, the distance 164 has a maximum value of 7 mm or less, such as 2 mm, 3 mm, 4 mm, 5 mm, 6 mm, 7 mm, or within any range bounded by any two of those values (e.g., 3 mm to 6 mm). In other words, no object having a smallest dimension larger than the maximum value of the distance 164 (e.g., 7 mm) could be inserted between the door 34 and the vent panel 160.

The placement of the axis of rotation 60 so close simultaneously to the bottom 38 of the door 34 and the external environment 46 allows the distance 164 to be so small simultaneously while allowing the door 34 to still move from the closed position 50 to the open position 48 without contacting the vent panel 160. A distance 166 separates the axis of rotation 60 from the exterior surface 52 of the door 34 facing the external environment 46, such as provided by the cover 156. The distance 166 is orthogonal to the axis of rotation 60 and horizontal. In embodiments, the distance 166 is within a range of 3 mm to 9 mm, such as 3 mm, 4 mm, 5 mm, 6 mm, 7 mm, 8 mm, 9 mm, or any range bounded by any two of those values (e.g., 4 mm to 8 mm).

In general, the smaller the distance 166 between the axis of rotation 60 and the exterior surface of the door 34, the smaller the distance 164 between the bottom 38 of the door 34 and the vent panel 160 can be. In ovens that include the door 34 with the glass panel 64 with the first primary surface 66 that faces the external environment 46, it may be desirable to maximize the height 84 and length 82 of the glass panel 64 to maximize the structural integrity of the door 34. However, the shape of the hinge assembly 54 providing the axis of rotation 60 for the door 34 includes the projection 88, which would occupy space that the glass panel 64 would occupy if the axis of rotation 60 is positioned closely to the exterior surface 52 of the door 34. The filler panel 92, with the recessed portion 100 accommodating the projection 88 of the hinge assembly 54, allows the distance 166 between the exterior surface of the door 34 and the axis of rotation 60 to be minimized while simultaneously occupying space that the glass panel 64 would have occupied within the door 34 in order to maintain the structural integrity of the door 34 that the glass panel 64 would have provided.

Referring now to FIGS. 15-20, the door 34, instead of being a component of the oven 10 of FIGS. 1-14 and being disposed over the vent panel 160, in embodiments, is a component of an oven 10A and is disposed over a second door 34A. In other words, the second door 34A is disposed below the door 34, when the door 34 is in the closed position 50. The oven 10A, as with the oven 10, includes the cooking chamber 16 but additionally includes a second cooking chamber 16A. The oven 10A is sometimes referred to as a "double wall oven." The oven 10A includes a base 12A, similar to the base 12, but further includes second inner walls 14A defining the second cooking chamber 16A and a second opening 18A into the second cooking chamber 16A. The second cooking chamber 16A is disposed below the cooking chamber 16. The second cooking chamber 16A can be identical to the cooking chamber 16 described above.

As mentioned above, the door 34 includes the bottom 38 when the door 34 is in the closed position 50. A distance 168 separates the bottom 38 of the door 34 from a top 36A of the second door 34A. The distance 168 is a straight-line that is orthogonal to the axis of rotation 60. This distance 168 has a maximum value of 7 mm or less, such as 2 mm, 3 mm, 4 mm, 5 mm, 6 mm, 7 mm, or within any range bounded by any two of those values (e.g., 3 mm to 6 mm). In other words, no object having a smallest dimension larger than 7 mm could be inserted between the door 34 and the second door 34A.

In embodiments, the second door 34A has the same features as the door 34 described above. In short, the second door 34A is pivotably coupled to the base 12A via a second hinge assembly 54A and another second hinge assembly 54A'. The second hinge assemblies 54A, 54A' are identical to the hinge assemblies 54, 54' described above, and the second hinge assemblies 54A, 54A' are attached to both the base 12A and the second door 34A in the same manner as the hinge assembly 54 is attached to both the base 12 and the door 34 described above. The second hinge assembly 54A provides a second axis of rotation 60A. The second door 34A is movable about the second axis of rotation 60A. The second axis of rotation 60A is parallel to the axis of rotation 60. The second door 34A is movable relative to the base 12A about the second axis of rotation 60A to, from, and between an open position 48A and a closed position 50A. In the open position 48A, the second door 34A allows access to the second cooking chamber 16A from the external environment 46 through the second opening 18A. In the closed position 50A, the second door 34A restricts access through the second opening 18A to the second cooking chamber 16A from the external environment 46.

The second door 34A includes a second glass panel 64A. The second glass panel 64A is the same as the glass panel 64 of the door 34 described above, including a first primary surface 66A and a second primary surface 68A. As mentioned, the first primary surface 66A is at least partially exposed to the external environment 46 when the second door 34A is in the closed position 50A.

As with the hinge assemblies 54, 54', the second hinge assemblies 54A, 54A' include the projection 88 extending toward the external environment 46 from the second axis of rotation 60A, when the second door 34A is in the closed position 50A. The second primary surface 68A of the second glass panel 64A forms a plane 80A that intersects with the projection 88 of the second hinge assemblies 54A, 54A'.

The second door 34A, like the door 34, further includes a second filler panel 92A. The second filler panel 92A is the same as the filler panel 92 described above. The second filler panel 92A is at least partially disposed below the second glass panel 64A when the second door 34A is in the closed position 50A. Same as the filler panel 92, the second filler panel 92A includes a first primary surface and a second primary surface (not separately illustrated). The first primary surface of the second filler panel 92A faces away from the second axis of rotation 60A and in a same direction as the first primary surface 66A of the second glass panel 64A. The second primary surface of the second filler panel 92A faces the second axis of rotation 60A and in a same direction as the second primary surface 68A of the second glass panel 64A. The second filler panel 92A includes a recessed portion 100A contiguous with the second primary surface 68A of the second filler panel 92A. The recessed portion 100A accommodates the projection 88 of the second hinge assembly 54A'. Although not separately illustrated, it should be understood that the second filler panel 92A includes another recessed portion to accommodate the projection 88 of the other second hinge assembly 54A'.

The oven 10A, like the oven 10, further includes the vent panel 160. The vent panel 160 is disposed below the second door 34A, when the second door 34A is in the closed position 50A. A distance 164A separates a bottom 38A of the second door 34A from the vent panel 160. The distance 164A is a straight-line orthogonal to the second axis of rotation 60A. In embodiments, the distance 164A has a maximum value of 7 mm or less, such as 2 mm, 3 mm, 4 mm, 5 mm, 6 mm, 7 mm, or within any range bounded by any two of those values (e.g., 3 mm to 6 mm). In other words, no object having a smallest dimension larger than 7 mm could be inserted between the second door 34A and the vent panel 160.

According to a first aspect of the present disclosure, an oven comprises: (1) a base comprising inner walls defining a cooking chamber and an opening into the cooking chamber; and (2) a door pivotably coupled to the base via a hinge assembly attached to both the base and the door, (a) the hinge assembly providing an axis of rotation about which the door is movable relative to the base to, from, and between (i) an open position allowing access to the cooking chamber from an external environment through the opening and (ii) a closed position restricting access through the opening to the cooking chamber from the external environment, (b) the door comprising a glass panel, the glass panel comprising a first primary surface and a second primary surface, the first primary surface being at least partially exposed to the external environment when the door is in the closed position, and (c) the hinge assembly comprising a projection extending toward the external environment from the axis of rotation, when the door is in the closed position; wherein, the second primary surface of the glass panel forms a plane that intersects with the projection of the hinge assembly.

According to a second aspect of the present disclosure, the first aspect, wherein the glass panel has a bottom edge that faces the hinge assembly.

According to a third aspect of the present disclosure, the second aspect, wherein the bottom edge of the glass panel is entirely more elevated than the axis of rotation when the door is in the closed position.

According to a fourth aspect of the present disclosure, any one of the first through third aspects, wherein the door further comprises a filler panel that is at least partially disposed below the glass panel when the door is in the closed position.

According to a fifth aspect of the present disclosure, the fourth aspect, wherein the filler panel is at least partially disposed between the axis of rotation and a plane that the first surface of the glass panel forms.

According to a sixth aspect of the present disclosure, any one of the fourth through fifth aspects, wherein (a) the filler panel comprises (i) a first primary surface that faces away from the axis of rotation and in a same direction as the first primary surface of the glass panel and (ii) a second primary surface that faces the axis of rotation and in a same direction as the second primary surface of the glass panel, and (b) both the first primary surface and the second primary surface of the filler panel are at least partially disposed between (i) a plane that the first primary surface of the glass panel forms and (ii) the axis of rotation.

According to a seventh aspect of the present disclosure, the sixth aspect, wherein the second primary surface of the filler panel forms a plane that intersects with the projection of the hinge assembly.

According to an eighth aspect of the present disclosure, any one of the sixth through seventh aspects, wherein the filler panel includes a recessed portion contiguous with the second primary surface that accommodates the projection of the hinge assembly.

According to a ninth aspect of the present disclosure, any one of the fourth through eighth aspects, wherein the filler panel includes a recessed portion contiguous with the second primary surface that accommodates the projection of the hinge assembly.

According to a tenth aspect of the present disclosure, the ninth aspect, wherein the door further comprises a double-sided adhesive strip adhered to both the tab of the filler panel and the second primary surface of the glass panel.

According to an eleventh aspect of the present disclosure, any one of the fourth through tenth aspects, wherein the filler panel comprises a tab that opposes a bottom edge of the glass panel when the door is in the closed position.

According to a twelfth aspect of the present disclosure, any one of the fourth through eleventh aspects, wherein the glass panel comprises a length parallel to the axis of rotation, and the filler panel comprises a length parallel to the axis of rotation that differs from the length of the glass panel by less than 5%.

According to a thirteenth aspect of the present disclosure, the twelfth aspect, wherein the door comprises a length parallel with the axis of rotation, and the length of the door differs from the length of the glass panel and the length of the filler panel by less than 5%.

According to a fourteenth aspect of the present disclosure, any one of the twelfth through thirteenth aspects, wherein (a) the glass panel further comprises (i) a bottom edge when the door is in the closed position and (ii) a height that is orthogonal to the length of the glass panel and (b) the filler panel further comprises a height that is orthogonal to the length of the filler panel, a portion of which height is disposed below the bottom edge of the glass panel when the door is in the closed position, and that portion of said height is within a range of 3% to 10% of the height of the glass panel.

According to a fifteenth aspect of the present disclosure, any one of the first through fourteenth aspects further comprising a vent panel disposed below the door when the door is in the closed position; wherein, the door further comprises a bottom when the door is in the closed position;

wherein, a distance separates the bottom of the door from the vent panel; wherein, the distance is a straight-line orthogonal to the axis of rotation; and wherein, the distance has a maximum value of 7 mm or less.

According to a sixteenth aspect of the present disclosure, any one of the first through fifteenth aspects, wherein (i) a distance separating the axis of rotation from an exterior surface of the door facing the external environment is within a range of 3 mm to 9 mm and (ii) the distance is horizontal and orthogonal to the axis of rotation.

According to a seventeenth aspect of the present disclosure, any one of the first through fourteenth aspects further comprising: a second door disposed below the door when the door is in the closed position, the second door pivotally coupled to the base, the base further comprising second inner walls defining a second cooking chamber disposed below the cooking chamber and a second opening into the second cooking chamber; wherein, the door further comprises a bottom when the door is in the closed position; wherein, a distance separates the bottom of the door from the second door; wherein, the distance is a straight-line that is orthogonal to the axis of rotation; and wherein, the distance has a maximum value of 7 mm or less.

According to an eighteenth aspect of the present disclosure, an oven comprises (1) a base comprising (i) inner walls defining a cooking chamber and an opening into the cooking chamber and (ii) second inner walls defining a second cooking chamber and a second opening into the second cooking chamber; (2) a first door pivotably coupled to the base via a hinge assembly attached to both the base and the first door, (a) the hinge assembly providing an axis of rotation about which the first door is movable relative to the base to, from, and between (i) an open position allowing access to the cooking chamber from an external environment through the opening and (ii) a closed position restricting access through the opening to the cooking chamber from the external environment, (b) the first door comprising a glass panel, the glass panel comprising a first primary surface and a second primary surface, the first primary surface being at least partially exposed to the external environment when the first door is in the closed position, and (c) the hinge assembly comprising a projection extending toward the external environment from the axis of rotation, when the first door is in the closed position, the second primary surface of the glass panel forming a plane that intersects with the projection of the hinge assembly; and (3) a second door pivotably coupled to the base via a second hinge assembly attached to both the base and the second door, (a) the second hinge assembly providing a second axis of rotation about which the second door is movable relative to the base to, from, and between (i) an open position allowing access to the second cooking chamber from an external environment through the second opening and (ii) a closed position restricting access through the second opening to the second cooking chamber from the external environment, (b) the second door comprising a second glass panel, the second glass panel comprising a first primary surface and a second primary surface, the first primary surface being at least partially exposed to the external environment when the second door is in the closed position, and (c) the second hinge assembly comprising a projection extending toward the external environment from the second axis of rotation, when the second door is in the closed position, the second primary surface of the second glass panel forming a plane that intersects with the projection of the second hinge assembly.

According to a nineteenth aspect of the present disclosure, wherein (a) the first door further comprises a filler panel that is at least partially disposed below the glass panel when the first door is in the closed position, and the filler panel includes (i) a first primary surface that faces away from the axis of rotation and in a same direction as the first primary surface of the glass panel and (ii) a second primary surface that faces the axis of rotation and in a same direction as the second primary surface of the glass panel, (b) the second door further comprises a second filler panel that is at least partially disposed below the second glass panel when the second door is in the closed position, and the second filler panel comprises (i) a first primary surface that faces away from the second axis of rotation and in a same direction as the first primary surface of the second glass panel and (ii) a second primary surface that faces the second axis of rotation and in a same direction as the second primary surface of the second glass panel, and (c) each of the filler panel and the second filler panel includes a recessed portion contiguous with the second primary surface, and the recessed portion accommodates the projection of the hinge assembly and the second hinge assembly respectively.

According to a twentieth aspect of the present disclosure, a door for an oven comprises: (1) a hinge assembly providing an axis of rotation for the door; (2) a glass panel, the glass panel comprising (i) a first primary surface providing an exterior surface of the door that is open to an external environment and (ii) a length parallel to the axis of rotation; and (3) a filler panel disposed (i) at least partially below the glass panel and (ii) at least partially between the axis of rotation and a plane that the first primary surface of the glass panel forms, the filler panel comprising a length parallel to the axis of rotation, and the length of the filler panel differs from the length of the glass panel by less than 5%.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature, unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An oven comprising:

a base comprising inner walls defining a cooking chamber and an opening into the cooking chamber;

a door movable between an open position where access to the cooking chamber is allowed from an external environment through the opening and a closed position where access to the cooking chamber is restricted from the external environment through the opening, the door comprising (a) a glass panel, the glass panel comprising a first primary surface, a second primary surface, and a bottom edge when the door is in the closed position, the first primary surface being at least partially exposed to the external environment when the door is in the closed position, (b) a filler panel that is at least partially disposed below the glass panel when the door is in the closed position, and (c) a cover partially encasing the glass panel and the filler panel, the cover (i) disposed between the external environment and both the glass panel and the filler panel, (ii) facing the first primary surface of the glass panel, and (iii) comprising a window through to the first primary surface of the glass panel; and a hinge assembly attached to both the base and the door, the hinge assembly (i) pivotably coupling the door to the base, (ii) providing an axis of rotation about which the door is movable relative to the base to, from, and between the open position and the closed position restricting access through the opening to the cooking chamber from the external environment, and (iii) comprising a projection extending toward the external environment from the axis of rotation and facing the bottom edge of the glass panel, when the door is in the closed position, wherein, the second primary surface of the glass panel forms a plane that intersects with the projection of the hinge assembly.

2. The oven of claim 1, wherein the bottom edge of the glass panel is entirely more elevated than the axis of rotation when the door is in the closed position.

3. The oven of claim 1, wherein the filler panel is at least partially disposed between the axis of rotation and a plane that the first primary surface of the glass panel forms.

4. The oven of claim 3, wherein the filler panel comprises (i) a first primary surface that faces away from the axis of rotation and in a same direction as the first primary surface of the glass panel and (ii) a second primary surface that faces the axis of rotation and in a same direction as the second primary surface of the glass panel; and both the first primary surface and the second primary surface of the filler panel are at least partially disposed between (i) the plane that the first primary surface of the glass panel forms and (ii) the axis of rotation.

5. The oven of claim 4, wherein the second primary surface of the filler panel forms a plane that intersects with the projection of the hinge assembly.

6. The oven of claim 4, wherein the filler panel includes a recessed portion contiguous with the second primary surface of the filler panel that accommodates the projection of the hinge assembly.

7. The oven of claim 1, wherein the filler panel comprises (i) a first tab that extends upwards, when the door is in the closed position, and that faces the second primary surface of the glass panel and (ii) a second tab that extends upwards, when the door is in the closed position, and faces the first primary surface of the glass panel.

8. The oven of claim 7, wherein the door further comprises a double-sided adhesive strip adhered to both the first tab of the filler panel and the second primary surface of the glass panel.

9. The oven of claim 1, wherein the filler panel comprises a tab that opposes a bottom edge of the glass panel when the door is in the closed position.

10. The oven of claim 1, wherein the glass panel comprises a length parallel to the axis of rotation, and the filler panel comprises a length parallel to the axis of rotation that differs from the length of the glass panel by less than 5%.

11. The oven of claim 10, wherein the door comprises a length parallel with the axis of rotation, and the length of the door differs from the length of the glass panel and the length of the filler panel by less than 5%.

12. The oven of claim 10, wherein the glass panel further comprises a height that is orthogonal to the length of the glass panel; and the filler panel further comprises a height that is orthogonal to the length of the filler panel, a portion of which height is disposed below the bottom edge of the glass panel when the door is in the closed position, and that portion of said height is within a range of 3% to 10% of the height of the glass panel.

13. The oven of claim 1 further comprising:

a vent panel disposed below the door when the door is in the closed position;

wherein, the door further comprises a bottom when the door is in the closed position;

wherein, a distance separates the bottom of the door from the vent panel;

wherein, the distance is a straight-line orthogonal to the axis of rotation; and wherein, the distance has a maximum value of 7 mm or less.

14. The oven of claim 1, wherein a distance separating the axis of rotation from an exterior surface of the door facing the external environment is within a range of 3 mm to 9 mm; and the distance is horizontal and orthogonal to the axis of rotation.

15. The oven of claim 1 further comprising:

a second door disposed below the door when the door is in the closed position, the second door pivotally coupled to the base, the base further comprising second inner walls defining a second cooking chamber disposed below the cooking chamber and a second opening into the second cooking chamber;

wherein, the door further comprises a bottom when the door is in the closed position;

wherein, a distance separates the bottom of the door from the second door;

wherein, the distance is a straight-line that is orthogonal to the axis of rotation; and wherein, the distance has a maximum value of 7 mm or less.

16. An oven comprising:

a base comprising (i) inner walls defining a cooking chamber and an opening into the cooking chamber and (ii) second inner walls defining a second cooking chamber and a second opening into the second cooking chamber;

a first door movable between an open position where access to the cooking chamber is allowed from an external environment through the opening and a closed position where access to the cooking chamber is restricted from the external environment through the opening, the first door comprising (a) a first glass panel, the first glass panel comprising a first primary surface, a second primary surface, and a bottom edge when the first door is in the closed position, the first primary surface being at least partially exposed to the external environment when the first door is in the closed position, (b) a first filler panel that is at least partially disposed below first glass panel when the first door is in the closed position, and (c) a first cover partially encasing the first glass panel and the first filler panel, the first cover (i) disposed the external environment and both the first glass panel and the first filler panel, (ii) facing the first primary surface of the first glass panel, and (iii) comprising a window through to the first primary surface of the first glass panel;

a first hinge assembly attached to both the base and the first door, the first hinge assembly (i) pivotably coupling the first door to the base, (ii) providing an axis of rotation about which the first door is movable relative to the base to, from, and between the open position and the closed position restricting access the opening to the cooking chamber from the external environment, and (iii) comprising a projection extending toward the external environment from the axis of rotation and facing the bottom edge of the first glass panel, when the first door is in the closed position, wherein, the second primary surface of the first glass panel forms a plane that intersects with the projection of the first hinge assembly;

a second door movable between an open position where access to the second cooking chamber is allowed from the external environment through the opening and a closed position where access to the second cooking chamber is restricted from the external environment through the opening, the second door comprising (a) a second glass panel, the second glass panel comprising a first primary surface, a second primary surface, and a bottom edge, the first primary surface being at least partially exposed to the external environment when the second door is in the closed position, (b) a second filler panel that is at least partially disposed below the second glass panel when the second door is in the closed position, and (c) a second cover partially encasing the second glass panel and the second filler panel, the second cover (i) disposed between the external environment and both the second glass panel and the second filler panel, (ii) facing the first primary surface of the second glass panel, and (iii) comprising a window through to the first primary surface of the second glass panel; and a second hinge assembly attached to both the base and the second door, the second hinge assembly (i) pivotably coupling the second door to the base, (ii) providing an axis of rotation about which the second door is movable relative to the base to, from, and between the open position and the closed position restricting access through the opening to the second cooking chamber from the external environment, and (iii) comprising a projection extending toward the external environment from the axis of rotation and facing the bottom edge of the second glass panel, when the second door is in the closed position, wherein, the second primary surface of the second glass panel forms a plane that intersects with the projection of the second hinge assembly.

17. The oven of claim 16, wherein the first filler panel includes (i) a first primary surface that faces away from the axis of rotation and in a same direction as the first primary surface of the first glass panel and (ii) a second primary surface that faces the axis of rotation and in a same direction as the second primary surface of the first glass panel;

the second filler panel comprises (i) a first primary surface that faces away from the second axis of rotation and in a same direction as the first primary surface of the second glass panel and (ii) a second primary surface that faces the second axis of rotation and in a same direction as the second primary surface of the second glass panel; and each of the first filler panel and the second filler panel includes a recessed portion contiguous with the respective second primary surface that accommodates the projection of the first hinge assembly and the second hinge assembly respectively.

18. A door for an oven comprising:

a hinge assembly providing an axis of rotation for the door;

a glass panel, the glass panel comprising (i) a first primary surface providing an exterior surface of the door that is open to an external environment, (ii) a length parallel to the axis of rotation, (iii) a bottom edge, and (iv) a second primary surface; and a filler panel disposed (i) at least partially opposing the bottom edge of the glass panel and (ii) at least partially between the axis of rotation and a plane that the first primary surface of the glass panel forms, the filler panel comprising:

a length parallel to the axis of rotation, and the length of the filler panel differs from the length of the glass panel by less than 5%;

a first tab that extends upwards, when the door is in the closed position, and that faces the second primary surface of the glass panel; and a second tab that extends upwards, when the door is in the closed position, and faces the first primary surface of the glass panel; and a cover partially encasing the glass panel and the filler panel, the cover (i) disposed between the external environment and both the glass panel and the filler panel, (ii) faces the first primary surface of the glass panel, and (iii) has a window through to the first primary surface of the glass panel.

19. The oven of claim 18, wherein the door further comprises a double-sided adhesive strip adhered to both the first tab of the filler panel and the second primary surface of the glass panel.

* * * * *